US007018764B2

(12) United States Patent
Matsumura et al.

(10) Patent No.: US 7,018,764 B2
(45) Date of Patent: Mar. 28, 2006

(54) TONER FOR DEVELOPING ELECTROSTATIC IMAGES, PROCESS FOR PREPARING TONER FOR DEVELOPING ELECTROSTATIC IMAGES, DEVELOPER FOR DEVELOPING ELECTROSTATIC IMAGES AND IMAGES FORMING METHOD

(75) Inventors: Yasuo Matsumura, Minamiashigara (JP); Kazuhiko Yanagida, Minamiashigara (JP); Manabu Serizawa, Minamiashigara (JP); Hidekazu Yaguchi, Minamiashigara (JP); Takahisa Fujii, Minamiashigara (JP); Tsutomu Kubo, Minamiashigara (JP); Shigeru Seitoku, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 111 days.

(21) Appl. No.: 10/464,556

(22) Filed: Jun. 19, 2003

(65) Prior Publication Data

US 2004/0058266 A1 Mar. 25, 2004

(30) Foreign Application Priority Data

Sep. 19, 2002 (JP) ..... 2002-273483
Mar. 10, 2003 (JP) ..... 2003-063162

(51) Int. Cl.
*G03G 9/087* (2006.01)
*G03G 9/08* (2006.01)

(52) U.S. Cl. ..... 430/110.2; 430/108.1; 430/109.2; 430/109.3; 430/110.3

(58) Field of Classification Search ..... 430/110.2, 430/109.2, 108.1, 109.3
See application file for complete search history.

(56) References Cited

U.S. PATENT DOCUMENTS

| | | | | | |
|---|---|---|---|---|---|
| 2,297,691 | A | * | 10/1942 | Carlson | 430/55 |
| 4,465,755 | A | * | 8/1984 | Kiritani et al. | 430/110.2 |
| 5,679,490 | A | * | 10/1997 | Yachi et al. | 430/109.3 |
| 5,698,354 | A | * | 12/1997 | Ugai et al. | 430/110.3 |
| 5,888,689 | A | * | 3/1999 | De Meutter et al. | 430/109.2 |

FOREIGN PATENT DOCUMENTS

| | | | |
|---|---|---|---|
| JP | 61277962 | A * | 12/1986 |
| JP | A 63-282752 | | 11/1988 |
| JP | A 6-250439 | | 9/1994 |
| JP | B2 3141783 | | 12/2000 |

OTHER PUBLICATIONS

Takagi, "On-Demand Full Color Digital Xerography Printing System [Color DocuTech 60]," Journal of the Imaging Soceity of Japan, vol. 40, No. 2, pp. 145-149, 2001.

* cited by examiner

*Primary Examiner*—Christohper Rodee
(74) *Attorney, Agent, or Firm*—Oliff & Berridge, PLC

(57) ABSTRACT

The present invention relates to a toner for developing electrostatic images characterized in that a reactive polymer which cross-links when heated at a temperature higher than a maximum temperature at the preparation of the toner for developing electrostatic images, at image fixation and/or after fixation, is contained in a toner for developing electrostatic images containing at least a binder resin, and/or is added to the surface thereof.

13 Claims, No Drawings

TONER FOR DEVELOPING ELECTROSTATIC IMAGES, PROCESS FOR PREPARING TONER FOR DEVELOPING ELECTROSTATIC IMAGES, DEVELOPER FOR DEVELOPING ELECTROSTATIC IMAGES AND IMAGES FORMING METHOD

CROSS-REFERENCE TO RELATED APPLICATION

This application claims priority under 35 USC 119 from Japanese patent Application Nos. 2002-273483 and 2003-63162, the disclosure of which is incorporated by reference herein.

BACKGROUND OF THE INVENTION

1. Field of the Invention

The present invention relates to a toner for developing electrostatic images which is used when an image is formed by an electrophotographic method or an electrostatic recording method, a developer for developing electrostatic images, a process for preparing a toner for developing electrostatic images, and an image forming method using the developer for developing electrostatic images.

2. Description of the Related Arts

A method for visualizing image information via an electrostatic image such as an electrophotographic method is utilized currently in a variety of fields. In an electrophotographic method, an electrostatic image is formed on a photosensitive material by an charging step and an exposing step, and an electrostatic latent image is developed with a developer containing a toner, which is visualized via a transferring step and a fixing step. As a developer used herein, there are a two-component developer composed of a toner and a carrier, and a one-component developer using a magnetic toner or a non-magnetic toner alone. As a process for preparing a toner, a kneading and grinding process is usually used in which a thermoplastic resin is melt-kneaded with a pigment, an charge control agent, and a releasing agent such as a wax, the mixture is cooled, finely-divided, and classified. If necessary, an inorganic or organic fine particle is added to the surface of a toner particle in some cases in order to improve the flowability and the cleanability.

In a conventional kneading and grinding process, since a shape of a toner and a surface structure of a toner are irregular and subtly changed depending on the grinding property of materials to be used and conditions of a grinding step, it is difficult to intentionally control a shape and a surface structure of a toner. In addition, in the case of a material having the particularly high grinding property, a mechanical force in a developing machine frequently leads to occurrence of a finer powder and change in a shape of a toner.

Due to these influences, in a two-component developer, deterioration of electrification of a developer is accelerated due to adhering of a fine powder to the surface of a carrier and, in a one-component developer, toner scattering occurs due to extension of a particle size distribution, and deterioration of the image quality easily occurs due to reduction in the developability derived from change in toner shape.

In addition, when a releasing agent such as a wax is added into a thermoplastic resin to formulate into a toner, a releasing agent is exposed on the surface of a toner in many cases depending on a combination with a thermoplastic resin. In particular, a toner comprising a combination of a resin which is given the elasticity by a high-molecular component and is slight difficult to grind, and a fragile wax-type releasing agent such as polyethylene, polyethylene is exposed on the surface thereof in many cases.

Although such the exposure is advantageous from the viewpoint of the releasability at fixing and cleaning of an untransferred toner from a photosensitive material, polyethylene present in a superficial layer of a toner is easily transferred to a developing roll, a photosensitive material, a carrier or the like by a mechanical force, to easily contaminate them, leading to reduction in reliance. In addition, since a toner shape is indefinite, even when a flowing assistant is added, the flowability can not be sufficiently maintained, a fine particle on the surface of a toner is transferred to a concave part by the action of a mechanical force during use, whereby, the flowability is reduced with time, a flowing assistant is embedded into the interior of a toner and, thus, the developability, the transferability and the cleanability are deteriorated.

In addition, when a toner recovered by cleaning is reused by returning to a developing machine, the image quality is easily reduced. When a flowing assistant is further increased in order to prevent these, it comes in the state where occurrence of a black spot on a photosensitive material and scattering of flowing assistant particle are caused.

Recently, as a method of intentionally controlling a toner shape and a surface structure, there has been proposed a process for preparing a toner by an emulsion polymerization aggregating method (for example, see Japanese Patent Application Laid-Open (JP-A) Nos. 63-282752 and 6-250439). Since the emulsion polymerization aggregating method usually uses a finely-divided raw material of 1 micron or smaller as a starting material, a small size toner can be effectively prepared in principle.

More particularly, the emulsion polymerization aggregating method is a process in which, in general, a resin dispersion prepared by emulsion polymerization and the like, and a colorant dispersion in which a colorant is dispersed in a solvent are mixed, to form an aggregated particle having a diameter corresponding to a toner particle diameter and, thereafter, the aggregated particles are coalesced together by heating to obtain a toner. However, since the surface and the interior of a toner usually become to have the same composition when following this method, it is difficult to intentionally control the surface composition.

In order to solve this problem, there has been proposed a means which enables more precise control of a particle structure by freely controlling layers from an inner layer to a superficial layer of a toner upon preparation of a toner by the emulsion polymerization aggregating method (see JP No. 3141783). Since this process can easily prepare a toner having a small diameter and can realize precise control of a particle structure, it has become possible to realize both remarkable improvement in the quality of an electrographic image and high reliance.

On the other hand, recently, an image forming method by electrophotography using the above-described toner and developer technology has begun to be applied to a part of a printing field with progress of digitalization and coloration, and has begun to be remarkably put into practice in the graphic art market including on-demand printing.

The graphic art market refers to a total business market relating to producing prints, such as copying and duplication of created print which is to be copied at a small copy number such as woodcut print, and of originals such as, handwriting and picture, and mass production printing called reproduction, and is defined as the market targeting industry associated with production of prints.

For example, in the short run printing market, not only monochromic printing utilizing the characteristics of plateless printing in electrophotography, but also the technologies targeting the short run color market, a representative of which is Fuji Xerox Co., Ltd. Color DocuTech60 have been developed, and have greatly progressed from the viewpoint of the image quality, the paper adaptability, the product price and the price per paper (Bulletin of Japan Image Society, Vol. 40 No. 2 2001).

However, when compared with original genuine conventional printing, although the on-demand characteristics as plateless printing are present, there arise deterioration of color reproduction region, resolution, image quality represented by the glossiness, the texture; deterioration of image uniformity in a single image, and the retainability of the image quality at continuous printing for a long period; high price per paper due to an amount of a consumed toner at a high image density; deterioration of the adaptability to a thinner paper and a thicker paper; the image defect and the deteriorated writability caused by a presence of an oil at image fixing; and high consumption of electric power at high speed high temperature fixing; elongation, curling, and waving of a paper due to image fixation at a high temperature and a high pressure, and a discrepancy in a register mark at printing on both surfaces, being problematic.

In addition, in principle, since a toner image comprising a low-molecular resin having a relatively low softening point is thermally fixed, there is a case where the thermal or mechanical durability of an image is weaker than that of a printed image. When a paper is bent multiply, or papers are subjected to bookbinding, piled multiply and exposed to a high temperature under the high load state, there arise problems on defect of an image, and on resistance to various stresses such as the light resistance and the weather resistance accompanied with blocking, offset and outdoor exposure, in some cases.

It has been found, in order that an image formed by electrophotography like this considerably replaces the previous printed material and pursues the market value, in particular, as a production means in the graphic art region, there are still a number of problems to be solved.

In addition, regarding a color reproduction region, kinds of pigments which have been put into practice in an electrophotographic field are smaller than kinds used in the previous printing ink, and the technologies for further high performance colorants are necessary. Since use conditions in the graphic art region are diverse as compared with the office market, not only the high color reproductivity, but also a variety of durabilities of an image such as the heat resistance, the light resistance, the waterproofing, the oilproofing, the resistance to solvent, the resistance to scuffing and the bending strength are required.

The resolution is easily restricted by a particle diameter of a toner and a distribution thereof as well as an image processing system, a photosensitive material and an exposure. There is the great technical problems in using a small size toner effectively and at a high reliance in respective processes such as electrification, development, transfer, fixing and cleaning.

Such the technical problems lie in, for example, a carrier for uniformly charging a small size toner, design of an charging blade and an charging roll, a developing system for obtaining the high image density without causing high background density, a transfer system for realizing precise transfer with high transfer efficiency, a fixing system for handling a combination of a small size toner and various papers, and a cleaning system for completely removing a small size toner from a photosensitive material or an intermediate transferred material, to realize a stable image quality.

In order to improve in-plane uniformity and the defects of an image, control of uniformity of the developing ability of a developer in an image forming system becomes important. In order to cope with the retainability of the image quality required in the printing market, there is required a highly durable developer which shows the stable charging property even in continuous printing of several thousand prints, maintains stable and uniform development, and is less dependent on the environment such as temperature and humidity. In addition, a developing system is required to avoid influence of a paper powder and foreign matters, be highly durable, suppress occurrence of defect and noise, and maintain the in-plane density uniformly.

In a system for performing transfer from a photosensitive material or an intermediate transferred material to a recording medium, an electrostatic transfer system is general in the current electrophotographic technology. In this electrostatic transfer system, in the case of a color image in which a thickness of an image of a toner becomes great by color overlapping, in order to suppress deterioration of an image due to toner scattering in transfer, optimization of a toner material and a transfer system for controlling the behavior of a toner in the electric field precisely is necessary. In addition, occasionally, a transfer system which can radically suppress toner scattering and which is not based on an electrostatic force such as adhering transfer becomes necessary.

As a cleaning system, it is important to optimize a system for cleaning a toner with a controlled shape such as a small diameter and a spherical shape at a high reliance and continuously without the environmental dependency by a method such as a blade, an electrostatic brush, a magnetic brush, web and cleaning simultaneous with development, also from a view point of optimizing a toner material, toner structure, and a hard system, as well as a highly durable photosensitive material.

For the cost per paper, it is necessary to reduce an amount of a consumed toner by a smaller diameter of a toner and optimization of an amount of a colorant. However, this easily influences on the uniformity of the image quality. For reducing the cost per paper, it is actually important to reduce "printed paper to be discarded" (waste output for obtaining the stable image quality) having the great influence on the price in printing, or reduce the maintenance load, by realizing an image forming system having a high reliance by the above-mentioned means.

In order to cope with the case where a material is a thin paper or thick paper, a toner material is required to have a property that, even when a material is a paper having little stiffness such as a thin paper or a plastic film, it is easy to peal a recording medium from a fixing members such as a fixing roll after fixation, and even when a material to be printed is a coated paper or a thick paper, low temperature fixation is possible in which an electric power consumed amount can be suppressed at the fixation.

Fixation at a low temperature and a low pressure can reduce a stress on a material, can suppress elongation, curling and waving of a material, and can overcome a problem such as a register mark discrepancy. In order to avoid the image defect and the deteriorated writability such as stain and streak due to an oil, an oil-less fixing apparatus and oil-less toner containing a releasing agent in the interior thereof become necessary.

In addition, in order to realize the image durability which is comparable to the usual printed image and does not cause a problem under various use circumstances, the property of a resin used in the previous toner must be further improved considerably.

In order to make the glossiness of an image to have a higher degree of freedom and to be uniform, control of the viscoelasticity of the toner and optimization of a fixing apparatus are important. In order to obtain an image having a high quality based on offset printing, realization of the optimal glossiness corresponding to a paper to be used is important in order to potentiate the market value, and optimization of a toner, a paper and a fixing system is necessary.

Further, the characteristic which is sought recently in the field such as on-demand printing is the environmental load performance. By on-demand printing business with network, the inventory can be eliminated or minimized. Thus, the environmental load accompanied with inventory, movement and waste thereof can be reduced, which is easily generated in the usual printing.

In addition, since a dry toner used in usual electrophotography does not use an organic solvent which is used in an ink used in a usual printing machine, the environmental load accompanied with VOC can be fundamentally reduced. For further improvement, not only reduction in the electric energy accompanied with fixation of an image and maintenance of condition of a hardware, but also reduction or nonuse of odor or volatile substance in a heated and melted resin generated at the fixation, and suppression of discharge of a small size toner component from a machine, are important subject. In addition, it is necessary to consider the recycling property of a wasted toner and a printed paper.

Like this, in order to fulfill the demand in the graphic art market and the short run market (which may be also referred to the simple printing market), the technology which is obtained by developing the previous electrophotographic technology further highly as a system, becomes necessary.

In such circumstances, in order to realize the higher image quality, design of the property of a resin becomes extremely important.

In order to realize a wide color reproduction region, it is necessary not only to optimize a color material but also optimize the melting property of a resin to obtain an image having a glossiness higher than a certain level. For doing so, the property of a resin is designed so that since the elasticity of a resin contained in a toner reduces upon heating of a toner by a fixing roll at the fixation, the melt viscosity reduces and the flowability of a resin increases. Therefore, in this case, it is necessary to reduce a molecular weight of a resin.

However, when an elasticity of a resin is reduced, the attachability between a fixing roll and a toner at the fixation is enhanced and, even when a releasing agent such as a wax is contained in a toner, it is difficult to peal the toner from a fixing roll in the state where an oil is not imparted on the surface of a hot roll. In addition, a toner having a lower molecular weight easily causes occurrence of hot offset at a high temperature, resulting in a toner having an extremely narrow usable temperature at the fixation.

When such the toner is used, since the fixing behavior becomes extremely sensitive to lowering of a temperature of a fixing roll at continuous printing and elevation of a temperature at heating of a heater built in a fixing roll, it becomes extremely difficult to control a temperature. Actually, since temperature influence due to the quality and a thickness of a paper is added to these factors, the control is further complicated.

In addition, when a molecular weight of a toner is lowered, even when the glossiness is increased, an image becomes fragile mechanically, the image defect is easily caused by folding of a recording medium such as a paper, and a problem is easily generated from the viewpoint of the durability of an image.

In addition, recently, in view of the environment, decrease in an amount of the energy to be used at the fixation, that is, decrease in a fixing temperature is desired. In order to lower a fixing temperature, it is effective to lower a glass transition temperature of a resin. However, when image formation, the retainability of an image after fixation, and the durability of the image are taken into consideration, it is difficult to use a resin exhibiting a low glass transition temperature as a material constituting a toner.

Further, an image formed by electrophotography as on-demand printing has recently been spreading as a substitute for simple printing. On the other hand, an image utilized in such a use is left for a long time under the environment at a high temperature and a high pressure when stored in a warehouse after bookbinding and piling in distribution process in many cases. When a printed material is left for a long time under the environment at a high temperature and a high pressure, an image formed by an electrophotographic method easily causes blocking of a printed material, and is remarkably inferior in the thermal durability as compared with an image printed with a usual printing ink. For this reason, a utilization field of an image formed by an electrophotographic method is limited. Further, when the glossiness is desired to be enhanced in order to obtain a high color region as described above, a problem on the thermal durability of the image has become more remarkable.

SUMMARY OF THE INVENTION

An object of the present invention is to solve the above-mentioned problems. That is, an object of the present invention is to provide a toner for developing electrostatic images which can form an image having the excellent thermal durability and mechanical property, a process for preparing a toner for developing electrostatic images, a developer for developing electrostatic images and an image forming method.

The above object can be attained by the following invention. That is:

One aspect of the invention is to provide a toner for developing electrostatic images, comprising a colorant and a binder resin, said toner containing a reactive polymer which cross-links when heated to a temperature that is higher than a maximum temperature during preparation of the toner.

Another aspect of the invention is to provide a process for preparing a toner for developing electrostatic images comprising at least an aggregating step of aggregating particles containing at least particles of a binder resin in a dispersion with the particles dispersed therein to obtain an aggregation of the particles, and a coalescing step of coalescing the aggregation of the particles by heating, said toner comprising a colorant, a binder resin, and a reactive polymer which cross-links when heated to a temperature that is higher than a maximum temperature during preparation of the toner.

Still another aspect of the invention is to provide a developer for developing electrostatic images, comprising a carrier and a toner for developing electrostatic images, said toner comprising a colorant, a binder resin, and a reactive polymer which cross-links when heated to a temperature that is higher than a maximum temperature during preparation of the toner.

Still another aspect of the invention is to provide an image forming method comprising at least the steps of forming an electrostatic latent image on an electrostatic image carrier, developing the electrostatic latent image using a developer to form a toner image, transferring the toner image on a transfer body, and thermally fixing the toner image, wherein a developer for developing electrostatic images is used as the developer, the developer for developing electrostatic images comprising a carrier and a toner for developing electrostatic images, said toner comprising a colorant, a binder resin, and a reactive polymer which cross-links when heated to a temperature that is higher than a maximum temperature during preparation of the toner.

DETAILED DESCRIPTION OF THE INVENTION

<Toner for Developing Electrostatic Images, Process for Preparing the Same, Developer for Developing Electrostatic Images>

The toner for developing electrostatic images of the present invention (hereinafter, abbreviated as "toner" in some cases) is characterized in that the toner comprises a colorant, a binder resin, and a reactive polymer which cross-links at a temperature higher than the maximum temperature at the preparation of the toner, and cross-links by being heated at a temperature higher than the maximum temperature at the preparation of the toner, at image fixation and/or after fixation.

Therefore, in the toner of the invention, a cross-linking reaction progresses at the fixation and/or after fixation, an image formed using this toner becomes fast, and has the excellent thermal durability and mechanical property. In this case, by the improvement in the thermal durability of the image, for example, blocking of a printed material under the environment at a high temperature and a high pressure can be prevented and, by the improvement in the mechanical durability of the image, the image defect caused by a friction of an image surface and a folding of an image part can be prevented.

Since the toner of the invention uses a reactive polymer which dose not cross-link at the preparation of a toner and cross-links at the fixation and/or after fixation, the properties of a toner associated with fixing treatment (e.g. molecular weight, elasticity, and flowability at the fixation (melt viscosity) of a binder resin constituting a toner, ratio of components constituting a toner such as content of a releasing agent etc.) and the properties of a toner associated with the thermal durability and the mechanical durability of the image formed by using a toner (e.g. content/externally added amount of a reactive polymer, and a structure and a physical property of a reactive polymer itself) can be designed separately.

For example, when the toner of the invention contains a binder resin having a low glass transition temperature and a reactive polymer, since a binder resin having a low glass transition temperature is used, low temperature fixation becomes possible in addition to the improvement in the thermal durability and the mechanical durability of the image, and an amount of the consumed energy at the fixation can be reduced.

As described above, the toner of the invention maintains the thermal and mechanical durabilities of the image and, moreover, can realize a variety of properties which are required as a toner besides them at a stable high level and, additionally, has a small variation of the fixing properties and properties of the image.

The reactive polymer used in the invention means that the reactivity accompanied with elevation of the temperature (extent of progression of cross-linking reaction) is substantially zero at a temperature equal to or less than the maximum temperature at the preparation of the toner, but is sufficiently great at the fixing temperature or higher. In this case, it is preferable that a cross-linking reaction is substantially almost completed at the fixation in a part contributing to a cross-linking reaction in a reactive polymer in terms of obtaining an image having the sufficient thermal and mechanical durabilities from immediately after fixation.

On the other hand, it is reported that, in the conventional toner using a polyester resin, a toner is utilized in image formation, wherein a reaction of polymerizing the polyester resin is stopped halfway at the preparation of the toner resin, and an unreacted functional group is reacted at the fixation (Japanese Patent Application Publication (JP-B) No. 1-28941).

However, since the physical properties of such the toner are influenced by progress of a reaction of polymerizing a polyester resin, and a reaction progresses even at melt kneading, it is difficult to strictly control them in a desired range, and there easily arises a variation in the fixing property, and the thermal durability and the mechanical durability of the image. In addition, since the improvement in the flowability at the fixation (melt viscosity), and the improvement in the thermal durability and the mechanical durability of the image after fixation, are in reciprocal relationship, it is difficult to realize both the fixing properties as well as the thermal durability and the mechanical durability of the image at a high level.

Besides them, an unreacted functional group in a polyester resin remaining after preparation of a toner gradually reacts therewith depending on the storage environment of the toner after preparation of the toner in some cases. In this case, there is a possibility that the physical properties of a toner are gradually changed, and a variation in the toner quality occurs.

In addition, the reactive polymer may be contained in a toner, or may be added to the surface of a toner. When the polymer is contained in a toner, it may function also as a binder resin, or the polymer may be separately provided from the binder resin. Alternatively, the polymer may function also as another component.

On the other hand, when the reactive polymer is added to the surface of a toner, the reactive polymer may be added to the surface of a toner as an external additive, and this external additive may have other functions.

The toner of the invention as explained above may be a toner prepared by any process, but is prepared via at least an aggregating step of aggregating a particle containing at least a fine particle of a binder resin (hereinafter, abbreviated as "binder resin fine particle" in some cases) in a dispersion with the particle dispersed therein, to obtain an aggregated particle, and a coalescing step of coalescing the aggregated particle by heating and, thereupon, it is preferable that the reactive polymer described above is contained in the toner prepared via such the steps and/or is added to the surface thereof. In addition, it is preferable that the process for preparing a toner of the invention includes the aggregating step and the coalescing step as described above (hereinafter, abbreviated as "toner preparing process of the invention").

Accordingly, one aspect of the invention is to provide a toner for developing electrostatic images, comprising a colorant and a binder resin, said toner containing a reactive polymer which cross-links when heated to a temperature that is higher than a maximum temperature during preparation of the toner, wherein the toner is prepared at least via an aggregating step of aggregating particles containing at least particles of the binder resin in a dispersion with the particles dispersed therein, to obtain an aggregation of the particles, and a coalescing step of coalescing the aggregation of the particles by heating.

In the toner preparing process of the invention, the maximum temperature at the preparation of a toner may be lower than a temperature at the fixation. For this reason, since a toner prepared by the toner preparing process of the invention can prevent progress of a cross-linking reaction of the reactive polymer as described above (or above-mentioned part contributing to a cross-linking reaction contained in a monomer as a raw material for this reactive polymer) in a process for preparing a toner, a sufficient cross-linking reaction can be proceeded at the fixation. In addition, it is preferable that the maximum temperature at the preparation of a toner is 100° C. or lower, and it is preferable that the temperature at the fixation exceeds at least 100° C., or practically is 120° C. or higher.

At present, it is practically difficult to obtain the toner of the invention by a process other than the toner preparing process of the invention.

For example, by a toner preparing process, in which a binder resin, a pigment and other additives are mixed, heated, kneaded, ground and classified to obtain a toner having a desired particle diameter, since the processing temperature at heating and kneading is 100° C. to 250° C. and is almost overlapped with the temperature range at the fixation, it is impossible to obtain the toner of the invention using such the toner preparing process.

The structure of the reactive polymer used in the invention is not particularly limited. The reactive polymer contains one or more kinds of reactive groups, and the reactive group performs a cross-linking reaction at a temperature higher than the maximum temperature at the preparation of the toner.

The reactive group is not particularly limited as far as it has the above-mentioned properties. It is preferable that the group is an organic compound group having a cyclic structure (hereinafter, referred to as "cyclic reactive group").

In this case, by selecting the kind of the cyclic reactive group, the number of the cyclic reactive groups contained in a reactive polymer, and the like, an image having the excellent thermal durability and mechanical durability can be obtained even when fixed at a lower temperature. In addition, by performing polymerization using a polymerizable monomer containing a cyclic reactive group, a reactive polymer having the desired properties can be obtained. The kind of a cyclic reactive group contained in a reactive polymer is not limited to one, but may be two or more.

The cyclic reactive group is not particularly limited as far as it can perform a cross-linking reaction by ring-opening at a temperature higher than at least 100° C., particularly preferably, in the range of 120° C. to 220° C. which is a general fixing temperature region, and is stable (dose not perform a cross-linking reaction) at the maximum temperature at the preparation of a toner (100° C.) or lower. Specifically, the group is preferably any one of an epoxy group, an aziridinyl group and oxazoline group.

In order to facilitate a cross-linking reaction by these cyclic reactive groups, it is preferable that a compound (low-molecular compound and/or high-molecular compound) containing a polar group is contained in a toner. This polar group is not particularly limited as far as it has great polarity, and a carboxyl group is particularly preferable. In addition, a polar group together with a cyclic reactive group may be contained in the same reactive polymer.

Accordingly, one aspect of the invention is to provide a toner for developing electrostatic images, comprising a colorant and a binder resin, said toner containing a reactive polymer which cross-links when heated to a temperature that is higher than a maximum temperature during preparation of the toner, wherein the reactive polymer contains one or more kinds of cyclic reactive groups which cross-link at a temperature that is higher than a maximum temperature during preparation of the toner.

Another aspect of the invention is to provide such toner for developing electrostatic images as described in the above-aspect, wherein the cyclic reactive group is any one of an epoxy group, an aziridinyl group and an oxazoline group.

Still another aspect of the invention is to provide such toner for developing electrostatic images as described in the above-aspect, wherein the reactive polymer is a vinyl type resin containing one or more kinds of cyclic reactive groups.

On the other hand, it is preferable that a binder resin constituting a toner is a vinyl type resin. Since the above-mentioned polyester resin is polymerized by polycondensation, when an unreacted functional group remains, polymerization further progresses in some cases even after the preparation of a toner, and a problem such as change in the properties of the toner arises in some cases. However, since a vinyl type resin is polymerized by addition polymerization, polymerization dose not progress after preparation of a toner and, thus, occurrence of a problem such as change in the properties of the toner can be suppressed.

In addition, it is preferable that a binder resin used in the invention is a reactive polymer (hereinafter, for convenience of explanation, particular designation that a binder resin is a reactive polymer is referred to as "binder resin/reactive polymer" in some cases). When a binder resin is a reactive polymer, a cross-linking reaction progresses over a wide range of an entire image, and a firmer image having the high thermal and mechanical durabilities is easily obtained.

In such case, it is preferable that the binder resin/reactive polymer contains a cyclic reactive group, and a fundamental structure of a binder resin itself is not particularly limited, but is preferably a vinyl type resin.

Accordingly, one aspect of the invention is to provide a toner for developing electrostatic images, comprising a colorant and a binder resin, said toner containing a reactive polymer which cross-links when heated to a temperature that is higher than a maximum temperature during preparation of the toner, wherein the binder resin is the reactive polymer.

When the binder resin/reactive polymer contains a cyclic reactive group, by selecting a structure of a main chain part of the binder resin/reactive polymer, and a number and a kind of cyclic reactive groups which bind to this main chain, the properties required as a binder resin, and the cross-linking reacting properties due to a cyclic reactive group can be easily optimized individually and separately.

In other words, like the case where a binder resin and a reactive polymer are contained in a polymer separately, both the desired properties as a binder resin and the desired properties as a reactive polymer can be realized at a high level.

Then, regarding a structure of a reactive polymer and its cross-linking reaction, an example of a vinyl type resin containing a cyclic reactive group will be explained, but the invention is not limited by the example.

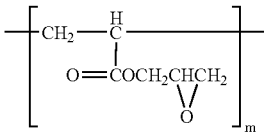

Compound 1 (GMA Copolymer)

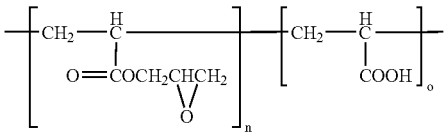

Compound 2 (Copolymer of GMA and a Monomer Containing a Carboxyl Group)

In the above Compound 1 (GMA copolymer), m denotes an integer, and a value thereof is not particularly limited, and can be in the range of 5 to 100000. In Compound 2 (copolymer of GMA and a monomer containing a carboxyl group), n and o independently denote an integer, and values thereof are not particularly limited, and n can be in the range of 2 to 100000, and o can be in the range of 2 to 1000000.

The above-described Compound 1 and Compound 2 indicate the case where a cyclic reactive group is an epoxy group, and the group may be replaced with other cyclic reactive group such as an aziridinyl group and an oxazoline group.

A cross-linking reaction using Compound 1 is possible using only Compound 1, but it is preferable that the reaction is performed in the presence of a carboxyl group as described above. Examples thereof include the case (reaction example A) where Compound 1 and a low-molecular compound containing two or more carboxyl groups such as dicarboxylic acid (e.g. dodecanediacid, sebacic acid, terephthalic acid etc.) are heated at the fixing temperature to obtain a cross-linked material, and the case (reaction example B) where Compound 1 and a carboxyl group-containing latex are heated at the fixing temperature to obtain a cross-linked material.

In addition, since Compound 2 contains an epoxy group and a carboxyl group in its molecule, a cross-linked material can be easily obtained by heating only Compound 2 at the fixing temperature (reaction example C).

When the above-described reaction examples A to C are compared, each has the following different advantages, respectively, and can be selected depending on the purpose.

For example, in the case of the reaction example A, by appropriately selecting a melting point of a low-molecular compound having two or more carboxyl groups such as dicarboxylic acid and the like to be used in a reaction, this low-molecular compound exerts the releasing agent effect like a wax and, at the same time, is diffused into a binder resin by the sharp melting behavior, or is dissolved out on the surface of a fixed image, whereby, a cross-linking reaction can be effectively promoted. In the case of the latter, it is possible to further improve the thermal durability and the mechanical durability of the surface of an image.

In addition, in the case of the reaction example B, as described later, when a toner has a core/shell structure, it is preferable to use a carboxyl group-containing latex as a binder resin for a shell. In this case, a reactive polymer can be assuredly separated by dividing into each part of a core and a shell, and a reaction of a reactive polymer is suppressed upon preparation of a toner.

Further, in the case of the reaction example C, only one kind of a binder resin can be enough, being simple and effective.

Accordingly, one aspect of the invention is to provide a toner for developing electrostatic images, comprising a colorant and a binder resin, said toner containing a compound having a carboxyl group and a reactive polymer which cross-links when heated to a temperature that is higher than a maximum temperature during preparation of the toner, wherein the reactive polymer contains one or more kinds of cyclic reactive groups which cross-link at a temperature that is higher than a maximum temperature during preparation of the toner.

Another aspect of the invention is to provide such toner for developing electrostatic images as described in the above-aspect, wherein the carboxyl group is a dicarboxylic acid.

Still another aspect of the invention is to provide such toner for developing electrostatic images as described in the above-aspect, wherein the compound having a carboxyl group is a carboxyl group-containing latex.

When a cyclic reactive group contained in a polymerizable monomer is an epoxy group, examples of a polymerizable monomer used in polymerizing a reactive polymer containing an exemplified cyclic reactive group in Compound 1 include epoxy group-containing monomers such as glycidyl methacrylate (GMA), glycidyl acrylate, 2-methylglycidyl methacrylate, 2-methylglycidyl acrylate, allyl glycidyl ether, glycidyl p-vinylbenzoate, methylglycidyl itaconate, glycidylethyl maleate, glycidylvinyl sulfonate, glycidyl-β-styrene sulfonate, glycidylallyl sulfonate, glycidylmethallyl sulfonate and the like.

In addition, when a cyclic reactive group contained in a polymerizable monomer is an aziridinyl group, examples include aziridinyl group-containing polymerizable monomers such as methacroylaziridine, acroylaziridine, 2-aziridinylethyl methacrylate, 2-aziridinylethyl acrylate and the like. When a cyclic reactive group contained in a polymerizable monomer is an oxazoline group, examples include oxazoline group-containing polymerizable monomers such as 2-isopropenyl-2-oxazoline, 2-vinyl 2-oxazoline and the like.

Upon polymerization, one kind of the above-exemplified polymerizable monomers, or a mixture of two or more of them may be used.

On the other hand, a reactive polymer containing a cyclic reactive group and a polar group represented by a carboxyl group, which is exemplified in Compound 2 can be obtained by copolymerizing a polymerizable monomer containing the above-exemplified cyclic reactive group, and a polymerizable monomer containing a polar group.

Examples of the polymerizable monomer containing a polar group include acrylic group, methacrylic acid, crotonic acid, maleic acid, fumaric acid, itaconic acid, and carboxyethyl acrylic acid, and monoester and salt thereof.

In addition, a kind of each of a polymerizable monomer containing a cyclic reactive group and a polymerizable monomer containing a polar group which are used upon copolymerization may independently be one, or two or more.

A low-molecular compound having two or more carboxyl groups is not particularly limited as far as it is the known low-molecular compound having two or more carboxyl groups in the molecule. For example, sebacic acid, dodecanediacid, malonic acid, octenylsuccinic acid, oxalic acid, fumaric acid, succinic acid, glutaric acid, dodecylsuccinic acid, adipic acid, pimelic acid, suberic acid, azelaic acid, maleic acid, citraconic acid, itaconic acid, glutaconic acid, isododecenylsuccinic acid, octylsuccinic acid, malic acid, terephalic acid, isophthalic acid, dodecenylsuccinic acid and the like can be used.

Among them, when used in combination with a vinyl type resin containing a cyclic reactive group in a wet process shown in the above-described reaction example A, it is particularly preferable that a low-molecular compound having two or more carboxyl groups is a substance having the extremely low solubility in water or is insoluble in water, and having a melting point in the range of 80° C. to 150° C. which is the fixing temperature region, the example of which is sebacic acid (melting point 135° C.) and dodecanediacid (melting point 127° C.).

The toner of the invention has a shape factor SF1 of, preferably, 140 or smaller, more preferably 135 or smaller. By rendering a shape factor SF1 of a toner 140 or smaller, the more excellent charging property, cleanability and transferability can be obtained.

When a shape factor SF1 exceeds 140, since a transfer efficiency upon transferring of a toner image formed in an electrostatic image carrier to a transferring material is lowered, the sufficient image density is not obtained and the image density becomes inhomogeneous in the image in some cases.

In addition, the lower limit of a shape factor SF1 is not particularly limited as far as it is 100 (i.e. perfect sphere) or larger, preferably 110 or larger.

A shape factor SF1 means the value represented by the following formula (1):

$$SF1=ML^2/(4A/\pi)\times 100 \qquad \text{Formula (1)}$$

[in the formula (1), ML represents the maximum length (μm) of a toner, and A represents a projected area ($\mu m^2$).].

A shape factor SF1 is measured using a Ruzex image analyzing apparatus (FT manufactured by Nicole) as follows:

First, a light microscope image of a toner dispersed on a slide glass was taken into a Ruzex image analyzing apparatus through a video camera, a circumferential length (ML) and a projected area (A)×100 of 50 or more toners are measured and, regarding individual toners, a square of circumferential length/(4π×projected area), that is, $ML^2/(4A/\pi)\times 100$ is calculated, the average of which is obtained as a shape factor SF1.

Accordingly, one aspect of the invention is to provide a toner for developing electrostatic images, comprising a colorant and a binder resin, said toner containing a reactive polymer which cross-links when heated to a temperature that is higher than a maximum temperature during preparation of the toner, and said toner having a shape factor SF1 represented by the formula (1) of 140 or less.

The toner of the invention has a surface index of, preferably 2.0 or smaller, more preferably 1.8 or smaller. By rendering a surface index of a toner 2.0 or smaller, since the transferability upon transferring a toner image to a recording medium becomes better, an uniform and higher image quality can be realized at a high transfer efficiency even in the case of a paper and a transferring medium having a large surface roughness.

When a surface index exceeds 2.0, since there are many irregularities on the toner surface, an adhering force to a photosensitive material or an intermediate transferred material increases, thus, it becomes difficult to obtain a high transfer efficiency in some cases.

A surface index means a value represented by the following formula (2):

(Surface index value)=(measured specific surface area value)/(calculated specific surface area value) Formula (2)

[in the formula (2), the calculated specific surface area value represents $6\Sigma(n\times R^2)/\{\rho\times\Sigma(n\times R^3)\}$ and, in the above formula representing the specific surface area, n represents the number of particle (number/1 channel) in a channel in a coulter counter, R represents a channel particle diameter (μm) in a coulter counter, ρ represents a toner density ($g/\mu m^3$), a dividing number of the channel is 16, and a size of division is the interval of 0.1 at a log scale]

In addition, in the formula (2), a measured specific surface area is measured based on a gas adsorption and desorption method, and is obtained by obtaining a Langmuir specific surface area. As a measuring apparatus, Coulter SA3100 type (manufactured by Beckman Coulter, Inc.) and Gemini 2360/2375 (manufactured by Shimadzu Corporation) can be used.

Accordingly, one aspect of the invention is to provide a toner for developing electrostatic images, comprising a colorant and a binder resin, said toner containing a reactive polymer which cross-links when heated to a temperature that is higher than a maximum temperature during preparation of the toner, and said toner having a surface index value represented by the formula (2) of 2.0 or less.

A glass transition point Tg of the toner of the invention is preferably in the range of 45 to 75° C., more preferably in the range of 48 to 60° C. When Tg is below 45° C., the aggregating force of a binder resin itself at a high temperature region is lowered, hot offset is easily caused upon fixation. When Tg exceeds 75° C., sufficient melting is not obtained, and the glossiness of a fixing sheet is lowered in some cases.

Accordingly, one aspect of the invention is to provide a toner for developing electrostatic images, comprising a colorant and a binder resin, said toner containing a reactive polymer which cross-links when heated to a temperature that is higher than a maximum temperature during preparation of the toner, wherein a glass transition temperature of the binder resin is in a range of 45° C. to 75° C.

A layer-structure of the toner of the invention is not particularly limited, but may comprise a di- or more-layered structure. In such case, a layered-structure containing at least a shell layer provided so as to cover the surface of a toner and a core layer provided on an inner side of the shell layer (so-called capsule structure) is preferable.

In such case, a reactive polymer may be contained in any layer, but in order to sufficiently maintain the thermal durability and the mechanical property of an image, the polymer is preferably contained in at least a core layer. When a reactive polymer is contained in only a shell layer, the thermal durability and the mechanical property of an image can not be sufficiently maintained in some cases.

In addition, when a binder resin is contained in both a core layer and a shell layer, it is preferable that a glass transition temperature of a binder resin contained in a core layer is lower than a glass transition temperature of a binder resin contained in a shell layer.

In such case, not only the thermal durability and the mechanical property of an image can be sufficiently maintained, but also both the low temperature fixing property and the preservability in and outside an image forming apparatus can be realized at a high level.

When the storage environment outside an image forming apparatus, and elevation of a temperature in an image forming apparatus at continuous image formation (the temperature reaches in the vicinity of 50° C. in some cases) are taken into consideration, a glass transition temperature of a binder resin contained in a shell layer is, specifically, preferably in the range of 45° C. to 75° C., more preferably in the range of 55° C. to 70° C.

In such case, even under the high temperature environment, caking (solidification and aggregation) of a toner can be assuredly prevented. Therefore, when such toner is used, it is possible to design an image forming system having a high reliance.

Accordingly, one aspect of the invention is to provide a toner for developing electrostatic images, comprising a colorant and a binder resin, said toner containing a reactive polymer which cross-links when heated to a temperature that is higher than a maximum temperature during preparation of the toner, wherein the toner has a layered-structure containing at least a shell layer provided so as to cover the surface thereof, and a core layer provided on an inner side of the shell layer.

Another aspect of the invention is to provide such toner for developing electrostatic images as described in the above-aspect, wherein the reactive polymer is contained at least in the core layer.

Another aspect of the invention is to provide such toner for developing electrostatic images as described in the above-aspect, wherein the binder resin is contained in the core layer and the shell layer, and a glass transition temperature of a binder resin contained in the core layer is lower than a glass transition temperature of a binder resin contained in the shell layer.

Still another aspect of the invention is to provide such toner for developing electrostatic images as described in the above-aspect, wherein a glass transition temperature of a binder resin contained in the core layer is in a range of 50° C. to 75° C.

An accumulated volume average particle diameter $D_{50}$ of the toner of the invention is preferably in the range of 3.0 to 9.0 μm, more preferably in the range of 3.0 to 8.0. When an accumulated volume average particle diameter $D_{50}$ is below 3.0 μm, the charging property becomes insufficient and the developability is lowered in some cases. In addition, when $D_{50}$ exceeds 9.0 μm, the resolution of an image is lowered.

In addition, it is preferable that a volume average particle size distribution index GSDv of the toner of the invention is 1.30 or smaller. When GSDv exceeds 1.30, the resolution is lowered, and this is responsible for the image defect such as toner scatter and fog.

Here, an accumulated volume average particle diameter $D_{50}$ and a volume average particle size distribution index GSDv can be obtained as follows: Against a particle size range (channel) divided based on a particle size distribution of a toner measured, for example, with a measuring device such as a coulter counter TAII (manufactured by Nikkaki), a multisizer II (manufactured by Nikkaki) and the like, accumulated distributions of a volume and a number are depicted from a small diameter side, respectively, a particle diameter at an accumulation 16% is defined as volume $D_{16V}$ and number $D_{16P}$, a particle diameter at an accumulation 50% is defined as volume $D_{50V}$ and number $D_{50P}$, and a particle diameter at an accumulation 84% is defined as volume $D_{84V}$ and number $D_{84P}$.

Thereupon, an accumulated volume average particle diameter $D_{50}$ is obtained as the above-described volume $D_{50V}$. In addition, a volume average particle size distribution index (GSDv) is obtained as $(D_{84V}/D_{16V})^{1/2}$.

An apparent weight average molecular weight of the toner of the invention is preferably in the range of 15,000 to 55,000, more preferably in the range of 20,000 to 48,000. When a weight average molecular weight is below 15,000, an aggregating force of a binder resin is easily lowered, and the peelability at oil-less fixation is lowered in some cases. When a weight average molecular weight exceeds 55,000, although the peelability at oil-less fixation is better, upon fixation, the smoothness of the image surface becomes poor, and the glossiness of an image is lowered in some cases.

-Materials Constituting a Toner-

Then, materials constituting a toner other than the above-described reactive polymer used in the invention will be explained.

A colorant used in the toner of the invention is not particularly limited as far as it is the known colorant, but the following can be used.

Examples of a black pigment include carbon black, copper oxide, manganese dioxide, aniline black, active carbon, non-magnetic ferrite, magnetite and the like.

Examples of a yellow pigment include chrome yellow, zinc yellow, yellow iron oxide, cadmium yellow, chromium yellow, hanza yellow, hanza yellow 10G, benzidine yellow G, benzidine yellow GR, threne yellow, quinoline yellow, permanent yellow NCG and the like.

Examples of an orange pigment include red chrome yellow, molybdenum orange, permanent orange GTR, pyrazolone orange, Vulcan orange, benzidine orange G, indantherene brilliant orange PK, indantherene brilliant orange GK and the like.

Examples of a red pigment include colcothar, cadmium red, red lead, mercury sulfide, watchang red, permanent red 4R, risol red, brillian carmine 3B, brillian carmine 6B, deiponoil red, pyrazolone red, rhodamine rake, rake red C, rose Bengal, Eoxine red, alizarin rake, quinacridone derivatives such as Pigment Red 122 and 202, Pigment Violet 19 and the like, naphthol red such as Pigment Red 146, 147, 184, 185, 155, 238, 269, and the like.

Examples of a blue pigment include Prussian blue, cobalt blue, alkali blue lake, Victoria blue lake, fast sky blue, indanthrene blue BC, aniline blue, ultramarine blue, chalcoil blue, methylene blue chloride, phthalocyanine blue, phthalocyanine green, malachite green oxalate and the like.

Examples of a purple pigment include manganese purple, fast violet B, methyl violet rake and the like.

Examples of a green pigment include chromium oxide, chromium green, Pigment Green, malachite green rake, final yellow green G and the like.

Examples white pigment include Chinese white, titanium oxide, antimony white, zinc sulfide and the like.

Examples of an extender pigment include barites powder, barium carbonate, clay, silica, white carbon, talc, alumina white and the like.

In addition, examples of a dye include various dyes such as basic, acidic, dispersion and substantive dyes, for example, Nigrocin, methylene blue, rose Bengal, quinoline yellow, ultra marine blue and the like.

These colorants are selected from the viewpoint of a hue angle, a chroma, a brightness, weathering resistance, OHP transmittance and dispersibility in a toner, and they may be contained alone in a toner, or two or more of them may be contained therein.

In addition, when the toner of the invention is prepared utilizing the toner preparing process of the invention, these colorants can be utilized as a dispersion of a colorant particle obtained by using, for example, a rotation shearing type homogenizer, media type dispersing machines such as a ball mill, a sand mill, attritor and the like, a high pressure opposite collision type disperser and the like, upon preparation of the toner of the invention. Alternatively, these colorants may be dispersed in an aqueous system with a homogenizer using a surfactant having the polarity.

It is preferable that a colorant to be added into the toner of the invention is added in the range of 4 to 15% by weight relative to a total weight of solid matters constituting the toner.

In addition, when a magnetic material is used as a black colorant, it can be added in the range of 12 to 240% by weight unlike other colorants.

When an amount of a colorant to be added is outside the above range, the developing property of an image formed using the toner of the invention is not sufficiently obtained in some cases. In addition, it is preferable that a center diameter (median diameter) of a colorant particle contained in the toner is in the range of 100 to 330 nm. When a center diameter is outside the above range, the transparency and the coloring property of an image upon formation of an image on OHP are not sufficiently obtained in some cases.

In addition, a central diameter of a colorant particle can be obtained by measuring, for example, with a laser diffraction particle size distribution measuring apparatus (LA-700 manufactured by Horiba, Ltd.).

When the toner of the invention is used as a magnetic toner, a magnetic powder may be contained in the toner. As this magnetic powder, specifically, a material which is magnetized in the magnetic field is used, and ferromagnetic powders such as iron, cobalt and nickel, or powders of compounds such as ferrite, magnetite and the like can be employed.

In addition, when the toner of the invention can be prepared in an aqueous phase, since a magnetic powder contained in the toner is sometimes flown out into an aqueous phase, in order to prevent this, it is preferable to modify the surface of a magnetic powder in advance (e.g. hydrophobicizing treatment etc.).

A binder resin used in the toner of the invention is not particularly limited as far as it is the known resin, but examples thereof include styrenes such as styrene and parachlorostyrene, vinyl esters such as vinyl naphthalene, vinyl chloride, vinyl bromide, vinyl fluoride, vinyl acetate, vinyl propionate, vinyl benzoate and vinyl butyrate, methylene aliphatic carboxylic acid esters such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate and butyl methacrylate, vinyl ethers such as acrylonitrile, methacrylonitrile, acrylamide, vinyl methyl ether, vinyl ethyl ether, vinyl isobutyl ether.

In addition, examples include monomers having a N-containing polar group such as N-vinyl compounds such as N-vinylpyrrole, N-vinylcarbazole, N-vinylindole, N-vinylpyrrolidone and the like, homopolymers and copolymers obtained by polymerizing one or more kinds of vinyl type monomers such as vinylcarboxylic acids such as methacrylic acid, acrylic acid, cinnamic acid and carboxyethyl acrylate, and various polyesters.

Only one kind of the above-exemplified binder resins can be used, or two or more kinds of them can be used. In addition to the binder resins described above, various waxes may be employed in combination with the binder resins.

When a binder resin used in the toner of the invention contains a polymer obtained by polymerization using at least one kind monomer, it is preferable that this polymer has considerably proceeded the polymerizing reaction.

When polymerization of a polymer is insufficient, since many unreacted functional groups remain in a polymer, there arise the above-described problems regarding the prior art (JP-B No. 1-28941).

When the toner of the invention is prepared by the toner preparing process of the invention, a dispersion containing a binder resin fine particle (binder resin fine particle dispersion) is utilized, and this binder resin fine particle dispersion is prepared, for example, as follows:

When a vinyl type monomer is used as a raw material for a binder resin fine particle, a binder resin fine particle dispersion can be prepared by implementing emulsion polymerization using an ionic surfactant. In addition, when a binder resin fine particle dispersion containing a binder resin fine particle other than a vinyl resin is prepared, if a resin is oily and dissolves in a solvent having the relatively low solubility in water, the resin is dissolved in the solvent, dispersed as a fine particle in water together with an ionic surfactant or a polymer electrolyte by a disperser such as a homogenizer and, thereafter, the dispersion is heated or evacuated to evaporate a solvent, whereby, a binder resin fine particle dispersion can be obtained.

A central diameter (median diameter) of a binder resin fine particle in the thus obtained binder resin fine particle dispersion is preferably 1 μm or smaller, more preferably in the range of 50 to 400 nm, particularly preferably in the range of 70 to 350 nm.

A center diameter of a binder resin fine particle is measured, for example, with a laser diffraction particle size distribution measuring apparatus (LA-700 manufactured by Horiba, Ltd.).

In addition, as an internal additive for the toner of the invention, magnetic materials such as a metal of ferrite, magnetite, reduced iron, cobalt, nickel, manganese and the like metal, an alloy thereof, and a compound containing these metals can be employed, or various charge control agents which are normally used, such as dyes comprising quaternary ammonium salt compound, nigrocin type compound, and a complex of aluminium, iron and chromium, and triphenylmethane type pigments can be employed.

When a toner is prepared utilizing the toner preparing process of the invention, as the internal additive, materials which are hard to solve in water are suitably used, from the viewpoint of control of ionic strength influencing on the stability in a liquid phase and decrease in waste water contamination in an aggregating step and a coalescing step.

A releasing used in the toner of the invention is not particularly limited as far as it is the known releasing agent, and examples thereof include low-molecular polyolefins such as polyethylene, polypropylene, polybutene and the like, silicones exhibiting a softening point by heating, fatty acid amides such as oleic acid amide, erucic acid amide, ricinolic acid amide, stearic acid amide and the like, plant type waxes such as carnauba wax, rice wax, candelilla wax, Japan wax, jojoba oil and the like, animal type waxes such as beeswax, mineral type and petroleum type waxes such as montan wax, ozokerite, ceresin, paraffin wax, microcrystalline wax, Fischer-Tropsch wax and the like, and modifications thereof.

These releasing agents hardly dissolve in a solvent such as toluene, or dissolve in the solvent in an extremely small amount around the room temperature.

In addition, when the toner of the invention is prepared utilizing the toner preparing process of the invention, these releasing agents are dispersed in water with an ionic surfactant or a polymer electrolyte such as polymer acid and polymer base, heated to above a melting point, and dispersed into a fine particle with a homogenizer or a pressure discharging-type dispersing machine (Gaulin homogenizer, manufactured by Gaulin) both of which have the strong shear imparting ability, whereby, they can be utilized as a dispersion containing a releasing agent particle having a particle diameter of 1 μm or smaller (releasing agent dispersion).

If necessary, in order to improve the weathering resistance of an image, a polymerizable ultraviolet ray-stable monomer may be used as a raw material upon preparation of a releasing agent dispersion.

As an example of such the polymerizable ultraviolet ray-stable monomer, piperidine type compounds such as 4-(meth)acryloyloxy-2,2,6,6-tetramethylpiperidine, 4-(meth)acryloylamino-2,2,6,6-tetrapiperidine, 4-(meth) acryloyloxy-1,2,2,6,6-pentamethylpiperidine, 4-(meth)acryloylamino-1,2,2,6,6-pentamethylpiperidine, 4-cyano-4-(meth)acryloylamino-2,2,6,6-tetramethylpiperidine, and 1-(meth)acryloyl-4-(meth)acryloylamino-2,2,6,6-tetramethylpiperidine are effective. These may be used alone or in combination of two or more of them.

It is desirable to add the above-exemplified releasing agents in the range of 5 to 25% by weight relative to a total weight of solid matters constituting a toner, in order to maintain the peelability between an image and a fixing roll upon fixation utilizing an oil-less fixing system.

In addition, a particle diameter of the resultant releasing agent particle dispersion can be measured, for example, with a laser diffraction type particle size distribution measuring apparatus (LA-700 manufactured by Horiba, Ltd.).

In addition, when a toner containing a releasing agent is prepared by the toner preparing process of the invention, it is preferable that an aggregating step is implemented according to the following procedures:

First, a binder resin fine particle dispersion, a colorant particle dispersion and a releasing agent particle dispersion are mixed, and an aggregate in which a binder resin fine particle, a colorant particle and a releasing agent particle are aggregated is obtained in this mixed solution. Then, a binder resin fine particle dispersion is further added to the mixed solution to adhere a binder resin fine particle to the surface of the aggregated particle. By performing the aggregating step like this, it becomes easy to maintain the charging property and the durability of a toner obtained by the toner preparing process of the invention.

Examples of a surfactant which is used for emulsion polymerization, seed polymerization, pigment dispersion, binder resin fine particle dispersion, releasing agent dispersion, aggregation or stabilization thereof upon preparation of the toner of the invention include anionic surfactants such as sulfate ester salt type surfactant, sulfonate salt type surfactant, phosphate ester type surfactant, soap type surfactant and the like, and cationic surfactants such as amine salt type surfactant, quaternary ammonium salt type surfactant and the like. And nonionic surfactants such as polyethylene glycol type surfactant, alkylphenol ethylene oxide adduct type surfactant, polyalcohol type surfactant and the like are effectively used in combination with the above-mentioned surfactant.

In addition, as means for dispersing various materials in a liquid phase upon preparation of the toner of the invention, general means such as a rotation shearing type homogenizer, and a ball mill, a sand mill and a DYNO-Mill, each of which has media, can be employed.

In addition, after the toner is dried as in the case of the usual toner in order to impart the flowability or improve the cleanability, an inorganic fine particle such as silica, alumina, titania and calcium carbonate, or a binder resin fine particle such as vinyl-resin, polyester and silicone as an external additive may be added to the surface of the toner of the invention in the dry state while applied shear.

On the other hand, an external additive may be added to the surface of the toner in water. In such case, when an external additive is an inorganic fine particle, an inorganic fine particle which can be used as an external additive to be added to the surface of the usual toner, such as silica, alumina, titania, calcium carbonate, magnesium carbonate and tricalcium phosphate is dispersed in water with an ionic surfactant, a polymer acid or a polymer base, and the external additive can be adhered to the surface of a toner.

In the toner preparing process of the invention, after completion of the coalescing step, the toner of the invention can be obtained via an arbitrary washing step, a solid-liquid separating step and a drying step. Upon this, in view of the charging property, it is desirable to perform replacement washing with ion-exchanged water sufficiently in the washing step. In addition, a solid-liquid separating step is not particularly limited, and suction filtration, pressurizing filtration and the like are suitable from the viewpoint of the productivity. Further, a drying step is not particularly limited, and freeze drying, flush jet drying, flowing drying, vibration type flowing drying and the like are preferably used from the viewpoint of the productivity.

When a toner having a multi-layered structure is prepared, the toner having a multi-layered structure can be obtained by repeating a step of adhering other particle to the surface of an aggregated particle which is to be a nucleus once or more, after the aggregated particle is formed.

For example, when a toner having a core/shell structure is prepared, the toner having a core/shell structure can be obtained via a step of forming an aggregated particle which is to be a core, and a step of forming an aggregated particle on which a layer which is to be a shell layer is provided by adhering a particle composed of a binder resin or the like to the surface of this aggregated particle which is to be a core layer.

Accordingly, one aspect of the invention is to provide a process for prepareing a toner for developing electrostatic images comprising at least an aggregating step of aggregating particles containing at least particles of a binder resin in a dispersion with the particles dispersed therein to obtain an aggregation of the particles, and a coalescing step of coalescing the aggregation of the particles by heating, said toner comprising a colorant and a binder resin, said toner containing a reactive polymer which cross-links when heated to a temperature that is higher than a maximum temperature during preparation of the toner, wherein the toner has a layered-structure containing at least a shell layer provided so as to cover the surface thereof, and a core layer provided on an inner side of the shell layer, and the aggregating step comprises a step of forming an aggregated particle which is to be the core layer, and a step of forming an aggregated particle on which a layer which is to be the shell layer is provided by adhering the particles to the surface of the aggregated particle which is to be the core layer.

-Developer for Developing Electrostatic Images-

The toner of the invention as explained above can be used as a developer for developing electrostatic images (hereinafter, abbreviated as "developer") by further combining with a carrier. That is, it is preferable that the developer of the invention contains the toner of the invention and a carrier.

The above-described carrier is not particularly limited as far as it is the known carrier, but an iron powder type carrier, a ferrite type carrier, a surface-coated ferrite carrier and the like can be employed.

Both of a carrier having a spherical shape and a carrier having an indefinite shape can be used. In addition, a volume average particle diameter of a carrier is preferably in the range of 20 μm to 150 μm, more preferably in the range of 25 to 80 μm.

<Image Forming Method>

Then, the image forming method of the invention will be explained.

The image forming method of the invention is an image forming method comprising at least a step of forming an electrostatic latent image on an electrostatic image carrier, a step of developing the electrostatic latent image using a developer to form a toner image, a step of transferring the toner image on a transfer body, and a step of thermally fixing the toner image, characterized in that the developer of the invention is used as said developer.

Since the image forming method of the invention forms an image using (the toner of the invention contained in) the developer of the invention, the resultant image has the excellent thermal durability and mechanical property. Therefore, when compared with an image formed by the previous image forming method, for example, blocking of a printed material under the environment at a high temperature and a high pressure can be prevented by improvement in the thermal durability of an image, and, the image defect due to friction of the image surface or folding of a part of an image, can be prevented by improvement in the mechanical durability of an image.

In addition, by adjusting the constituent materials and the physical properties of the toner of the invention contained in a developer used upon image formation as described above, besides improvement in the thermal and mechanical durabilities of an image, the excellent developability and transferability can be obtained upon image formation, and a high quality image having a wide color reproduction range can be formed. Further, since it is possible to perform fixation at a lower temperature, an amount of the energy to be used at the fixation can be reduced.

The image forming method of the invention is not particularly limited as far as it includes at least above-described four steps, and may include other steps, if necessary.

EXAMPLES

The present invention will be explained in detail by way of Examples below, but the invention is not limited by Examples explained below.

Toners shown in Examples and Comparative examples are prepared according to the following procedures. First, a binder resin fine particle dispersion, a colorant particle dispersion, and a releasing agent particle dispersion are prepared, respectively, and a polymerized metal salt is added while mixing them at a prescribed ratio and stirring them, to ionically neutralize them to form an aggregated particle.

Then, an inorganic hydroxide is added to a solution containing the aggregated particle, a pH of a solution is adjusted to neutral from weekly acidic and, thereafter, the solution is heated to a temperature which is higher than a glass transition point of the binder resin fine particle to coalesce and combine aggregated particles. Further, via a step of sufficient washing, a solid-liquid separating step, and a drying step, the desired toner is obtained. The above-explained procedures will be explained detail below.

(Preparation of Binder Resin Fine Particle Dispersion (1))

Styrene: 460 parts by weight

N-butyl acrylate: 140 parts by weight

Acrylic acid: 12 parts by weight

Glycidyl mathacrylate: 6 parts by weight

Dodecanethiol: 12 parts by weight

First, a monomer solution A in which the above components are mixed and dissolved is prepared.

Separately, 12 parts by weight of an anionic surfactant (Dowfax, manufactured by Dow Chemical Company) is dissolved in 250 parts by weight of ion-exchanged water, and to this is added the above monomer solution A to perform dispersing in a flask to obtain an emulsified solution (monomer emulsion A).

Then, 1 part by weight of an anionic surfactant (Dowfax, manufactured by Dow Chemical Company) is dissolved in 555 parts by weight of ion-exchanged water, and the solution is placed into a polymerization flask. Thereafter, the polymerization flask is sealed, a reflux condenser is mounted, and the solution in the polymerization flask is heated to 75° C. in a water bath and maintained at that temperature while nitrogen is introduced and the solution is stirred.

In this state, a solution obtained by dissolving 9 parts by weight of ammonium persulfate in 43 parts by weight of ion-exchanged water is added dropwise to the polymerization flask over 20 minutes via a quantitative pump and, thereafter, the monomer emulsion A is further added dropwise thereto over 200 minutes via a quantitative pump. After completion of addition, the solution in the polymerization flask is retained at 75° C. for 3 hours while continuing to be slowly stirred, to complete polymerization, whereby, an anionic binder resin fine particle dispersion (1) having an amount of solids of 42% is obtained.

A center diameter, a glass transition point, and a weight average molecular weight of a binder resin fine particle contained in the anionic binder resin fine particle dispersion (1) are 220 nm, 51.5° C. and 24000, respectively, and a cross-linking reaction progresses at 120° C. or higher.

(Preparation of Binder Resin Fine Particle Dispersion (2))

According to the same manner as that for the binder resin fine particle dispersion (1) except that an amount of acrylic acid in a monomer solution A is changed to 9 parts by weight and an amount of dodecanethiol is changed to 15 parts by weight in preparation of a binder resin fine particle dispersion (1), a binder resin fine particle dispersion is prepared, and an anionic binder resin fine particle dispersion (2) having an amount of solids of 42% is obtained.

A centrer diameter, a glass transition point and a weight average molecular weight of a binder resin fine particle contained in the anionic resin fine particle dispersion (2) are 200 nm, 45.5° C. and 15500, respectively, and a cross-linking reaction progresses at 120° C. or higher.

(Preparation of Binder Resin Fine Particle Dispersion (3))
Styrene: 500 parts by weight
N-Butyl acrylate: 100 parts by weight
Methacrylic acid: 15 parts by weight
2-Aziridinylethyl acrylate: 6 parts by weight
Dodecanethiol: 6 parts by weight According to the same manner as that for preparation of the binder resin fine particle dispersion (1) except that a monomer solution B obtained by mixing and dissolving the above components is used in place of the monomer solution A, a binder resin fine particle dispersion is prepared, and an anionic binder resin fine particle dispersion (3) having an amount of solids of 42% is obtained.

A center diameter, a glass transition point and a weight average molecular weight of a binder resin fine particle contained in the anionic binder resin fine particle solution (3) are 180 nm, 58.8° C. and 39000, respectively, and a cross-linking reaction progresses at 120° C. or higher.

(Preparation of Binder Resin Fine Particle Dispersion (4))
Styrene: 500 parts by weight
N-butyl acrylate: 100 parts by weight
Carboxyethyl acrylate: 30 parts by weight
2-Vinyl-2-oxazoline: 6 parts by weight
Dodecanethiol: 9 parts by weight According to the same manner as that for preparation of the binder resin fine particle dispersion (1) except that a monomer solution C obtained by mixing and dissolving the above components is used in place of the monomer solution A, a binder resin fine particle dispersion is prepared, and an anionic binder resin fine particle dispersion (4) having an amount of solids of 42% is obtained.

A center diameter, a glass transition point and a weight average molecular weight of a binder resin fine particle contained in the anionic binder resin fine particle dispersion (4) are 240 nm, 55.5° C. and 28000, respectively, and a cross-linking reaction progresses at 120° C. or higher.

(Preparation of Binder Resin Fine Particle Dispersion (5))

According to the same manner as that for the binder resin fine particle dispersion (1) except that an amount of glycidyl methacrylate in a monomer solution A is changed to 0 part by weight in preparation of a binder resin fine particle dispersion (1), an anionic binder resin fine particle dispersion (5) having an amount of solids of 42% is obtained.

A center diameter, a glass transition point and a weight average molecular weight of a binder resin fine particle contained in the anionic binder resin fine particle dispersion (5) are 200 nm, 46.5° C. and 17000, respectively.

(Preparation of Binder Resin Fine Particle Dispersion (6))
Styrene: 520 parts by weight
N-butyl acrylate: 80 parts by weight
Acrylic acid: 12 parts by weight
Dodecanethiol: 18 parts by weight First, a monomer solution D in which the above components are mixed and dissolved is prepared.

Separately, 12 parts by weight of an anionic surfactant (Dowfax, manufactured by Dow Chemical Company) is dissolved in 250 parts by weight of ion-exchanged water, and to this is added the above monomer solution D to perform dispersing in a flask to obtain an emulsified solution (monomer emulsion B).

Then, 1 part by weight of an anionic surfactant (Dowfax, manufactured by Dow Chemical Company) is dissolved in 555 parts by weight of ion-exchanged water, and the solution is placed into a polymerization flask. Thereafter, the polymerization flask is sealed, a reflux condenser is mounted, and the solution in the polymerization flask is heated to 75° C. in a water bath and maintained at that temperature while nitrogen is introduced and the solution is slowly stirred.

In this state, a solution obtained by dissolving 9 parts by weight of ammonium persulfate in 43 parts by weight of ion-exchanged water is added dropwise to the polymerization flask over 20 minutes via a quantitative pump and, thereafter, the monomer emulsion B is further added dropwise thereto over 200 minutes via a quantitative pump. After completion of addition, the solution in the polymerization flask is retained at 75° C. for 3 hours while continuing to be slowly stirred, to complete polymerization, whereby, an anionic binder resin fine particle dispersion (6) having an amount of solids of 42% is obtained.

A center diameter, a glass transition point, and a weight average molecular weight of a binder resin fine particle contained in this binder resin fine particle dispersion (6) are 200 nm, 60.5° C. and 19000, respectively.

(Preparation of Binder Resin Fine Particle Dispersion (7))
Styrene: 540 parts by weight
N-butyl acrylate: 60 parts by weight
Carboxylacrylic acid: 18 parts by weight
Dodecanethiol: 18 parts by weight According to the same manner as that for the binder resin fine particle dispersion (6) except that a monomer solution D in which the above components are mixed and dissolved is used in place of the monomer solution D, an anionic binder resin fine particle dispersion (7) having an amount of solids of 42% is obtained.

A center diameter, a glass transition point and a weight average molecular weight of a binder resin fine particle contained in this binder resin fine particle dispersion (7) are 190 nm, 61.5° C. and 17000, respectively.

(Preparation of Binder Resin Fine Particle Dispersion (8))
Styrene: 420 parts by weight
N-butyl acrylate: 180 parts by weight
Acrylic acid: 12 parts by weight
Glycidyl methacrylate: 6 parts by weight
Dodecanethiol: 12 parts by weight First, a monomer solution F in which the above components are mixed and dissolved is prepared.

Separately, 12 parts by weight of an anionic surfactant (Dowfax, manufactured by Dow Chemical Company) is dissolved in 250 parts by weight of ion-exchanged water, and to this is added the above monomer solution F to perform dispersing in a flask to obtain an emulsified solution (monomer emulsion C).

Then, 1 part by weight of an anionic surfactant (Dowfax, manufactured by Dow Chemical Company) is dissolved in 555 parts by weight of ion-exchanged water, and the solution is placed into a polymerization flask. Thereafter, the polymerization flask is sealed, a reflux condenser is mounted, and the solution in the polymerization flask is heated to 75° C. in a water bath and maintained at that temperature while nitrogen is introduced and the solution is slowly stirred.

In this state, a solution obtained by dissolving 9 parts by weight of ammonium persulfate in 43 parts by weight of ion-exchanged water is added dropwise to the polymerization flask over 20 minutes via a quantitative pump and, thereafter, the monomer emulsion C is further added dropwise thereto over 200 minutes via a quantitative pump. After completion of addition, the solution in the polymerization flask is retained at 75° C. for 3 hours while the solution continues to be slowly stirred, to complete polymerization, whereby, an anionic binder resin fine particle dispersion (8) having an amount of solids of 42% is obtained.

A center diameter, a glass transition point, and a weight average molecular weight of a binder resin fine particle contained in this binder resin fine particle dispersion (8) are 220 nm, 48.5° C. and 25000, respectively, and a cross-linking reaction progresses at 110° C. or higher.

(Preparation of Binder Resin Fine Particle Dispersion (9))

According to the same manner as that for the binder resin fine particle dispersion (8) except that an amount of styrene is changed to 400 parts by weight and an amount of n-butyl acrylate is changed to 200 parts by weight in preparation of the binder resin fine particle dispersion (8), an anionic resin fine particle dispersion (9) having an amount of solids of 42% is obtained.

A center diameter, a glass transition point and a weight average molecular weight of a binder resin fine particle contained in this binder resin fine particle dispersion (9) are 200 nm, 45.0° C. and 19500, respectively, and a cross-linking progresses at 110° C. or higher.

(Preparation of Binder Resin Fine Particle Dispersion (10))

Styrene: 480 parts by weight
N-butyl acrylate: 120 parts by weight
Methacrylic acid: 15 parts by weight
2-Aziridinylethyl acrylate: 6 parts by weight
Dodecanethiol: 6 parts by weight According to the same manner as that for a binder resin fine particle dispersion (8) except that a monomer solution G in which the above components are mixed and dissolved is used in place of a monomer solution F, an anionic binder resin fine particle dispersion (10) having an amount of solids of 42% is obtained.

A center diameter, a glass transition point and a weight average molecular weight of a binder resin fine particle contained in this binder resin fine particle dispersion (10) are 190 nm, 53.8° C. and 33000, respectively, and a cross-linking progresses at 120° C. or higher.

(Preparation of Binder Resin Fine Particle Dispersion (11))

Styrene: 400 parts by weight
N-butyl acrylate: 200 parts by weight
Carboxyethyl acrylate: 30 parts by weight
2-Vinyl-2-oxazoline: 6 parts by weight
Dodecanethiol: 9 parts by weight According to the same manner as that for the binder resin fine particle dispersion (8) except that a monomer solution H in which the above components are mixed and dissolved is used in place of the monomer solution F, an anionic binder resin fine particle dispersion (11) having an amount of solids of 42% is obtained.

A center diameter, a glass transition point and a weight average molecular weight of a binder resin fine particle contained in this binder resin fine particle dispersion (11) are 230 nm, 45.5° C. and 24000, respectively, and a cross-linking progresses at 110° C. or higher.

(Preparation of Dicarboxylic Acid Compound Dispersion (1))

Dodecanediacid (melting point 127° C.): 50 parts by weight
Anionic surfactant (Dowfax manufactured by Dow Chemical Company): 5 parts by weight
Ion-exchanged water: 200 parts by weight The above components are heated to 130° C., dispersed well with a homogenizer (Ultratarax T50 manufactured by IKA), and subjected to dispersing treatment with a pressure discharging-type homogenizer (Gaulin homogenizer manufactured by Gaulin) to obtain a dicarboxylic acid compound dispersion (1) having a center diameter of 160 nm and an amount of solids of 21.5%.

(Preparation of Dicarboxylic Acid Compound Dispersion (2))

Sebacic acid (melting point 135° C.): 50 parts by weight
Anionic surfactant (Dowfax manufactured by Dow Chemical Company): 5 parts by weight
Ion-exchanged water: 200 parts by weight The above components are heated to 140° C., dispersed well with a homogenizer (Ultratarax T50 manufactured by IKA), and subjected to dispersing treatment with a pressure discharging-type homogenizer (Gaulin homogenizer manufactured by Gaulin) to obtain a dicarboxylic acid compound dispersion (2) having a center diameter of 190 nm and an amount of solids of 21.5%.

(Preparation of Colorant Particle Dispersion (1))

Thian pigment (Pigment Blue 15:3 manufactured by Dainippon Ink and Chemicals, Incorporated): 50 parts by weight
Anionic surfactant (Neogen R manufactured by Dai-ichi Kogyo Seiyaku Co., Ltd.): 5 parts by weight
Ion exchanged water: 200 parts by weight The above components are mixed and dissolved, pre-dispersed with a homogenizer (Ultratarax manufactured by IKA) for 10 minutes, and further dispersed with a sand mill for 2 hours to obtain a Thian colorant particle dispersion (1) having a center diameter of 140 nm and an amount of solids of 21.5%.

(Preparation of Colorant Particle Dispersion (2))

According to the same manner as that for the colorant particle dispersion (1) except that a magenta pigment (dimethylquinacridone Pigment Red 122 manufactured by Dainichiseika Color and Chemicals Mfg. Co., Ltd.) is used in place of the Thian pigment in preparation of the colorant particle dispersion (1), a magenta colorant particle dispersion (2) having a center diameter of 120 nm and an amount of solid matters of 21.5% is obtained.

(Preparation of Colorant Particle Dispersion (3))

According to the same manner as that for the colorant particle dispersion (1) except that a yellow pigment (Pigment Yellow 93 manufactured by Clariant (Japan) K.K.) is used in place of the Thian pigment in preparation of the colorant particle dispersion (1), a colorant particle dispersion (3) having a center diameter of 185 nm and an amount of solids of 21.5% is obtained.

(Preparation of Colorant Particle Dispersion (4))

According to the same manner as that for the colorant particle dispersion (1) except that a black pigment (Carbon black manufactured by Cabot Corporation) is used in place of the Thian pigment in preparation of the colorant particle dispersion (1), a colorant particle dispersion (4) having a center diameter of 170 nm and an amount of solids of 21.5% is obtained.

(Preparation of Releasing Agent Particle Dispersion (1))

Paraffin wax (HNPO190 manufactured by Nippon Seiro Co., Ltd.; melting point 85° C.): 50 parts by weight
Anionic surfactant (Dowfax manufactured by Dow Chemical Company): 5 parts by weight
Ion-exchanged water: 200 parts by weight The above components are heated to 95° C., well dispersed with a homogenizer (Ultratarax T50 manufactured by IKA) and subjected to dispersing treatment with a pressure discharge-type homogenizer (Gaulin homogenizer manufactured by Gaulin) to obtain a releasing agent particle dispersion having a center diameter of 180 nm and an amount of solids of 21.5%.

Example 1

(Preparation of Toner Particle and Developer)

-Aggregating Step-

Binder resin fine particle dispersion (1): 200 parts by weight (resin 84 parts by weight)

Colorant particle dispersion (1): 40 parts by weight (pigment 8.6 parts by weight)

Releasing agent particle dispersion:40 parts by weight (releasing agent 8.6 parts by weight)

Polyaluminium chloride: 0.15 part by weight

The above components are well mixed and dispersed with a homogenizer (Ultratarax T50 manufactured by IKA) in a round-type stainless flask, the dispersion in the flask is heated to 48° C. in a heating oil bath while stirred, retained at 48° C. for 60 minutes, and 68 parts by weight (resin 28.56 parts by weight) of the binder resin fine particle dispersion (1) is added and they are stirred slowly.

-Coalescing Step-

Thereafter, a pH of the dispersion in the flask is adjusted to 6.0 with a 0.5 mol/liter aqueous sodium hydroxide solution, and the dispersion in the flask is heated to 95° C. while continuing to be stirred. After heating of the dispersion in the flask to 95° C. is completed, this state is maintained for 4 hours. When the temperature of the dispersion is retained at 95° C., the pH thereof is around 5.0.

-Filtering, Washing and Drying Steps-

After completion of the reaction, the solution in the flask is cooled and filtered to obtain solid matters. Then, the solid matters are washed well with ion-exchanged water, followed by solid-liquid separation by Nuche suction filtration to obtain again solid matters.

Then, the solid matters are dispersed again in 3 liter of ion-exchanged water at 40° C., then the dispersion is stirred and washed at 300 rpm for 15 minutes. This washing procedure is repeated 5 times, and subjected to solid-liquid separation by Nuche suction filtration to obtain solid matters, which are dried under vacuum for 12 hours to obtain a toner particle.

A particle diameter of this toner particle is measured with a coulter counter, and an accumulated volume average particle diameter $D_{50}$ is 5.9 μm, a volume average particle size distribution index GSDv is 1.20, and a surface index is 1.55. In addition, a shape factor SF1 of the toner particle obtained by shape observation with a Ruzex image analyzing apparatus is 126 (potato shape).

-Addition of External Additive and Preparation of Developer-

Then, 1.2 parts by weight of hydrophobic silica (TS720 manufactured by Cabot Corporation) is added to 50 parts by weight of the above toner particle, and the materials are mixed with a sample mill to obtain a toner particle (toner of Example 1), with hydrophobic silica externally added to the surface of the toner particle.

Thereafter, a ferrite carrier having an average particle diameter of 50 μm in which the surface of the ferrite particle is covered with polymethyl methacrylate (manufactured by Soken Chemical & Engineering Co., Ltd.) (a blending ratio of polymethyl methacryalte relative to ferrite particle; 1% by weight) is mixed therein so that the concentration of the toner particle with hydrophobic silica externally added thereto becomes 5% by weight, and they are stirred and mixed with a ball mill for 5 minutes to obtain a developer of Example 1.

(Assessment)

In assessment of a toner (developer), images are formed on a transfer paper with an image forming apparatus (modified DC1250 manufactured by Fuji Xerox Co., Ltd.) using the developer of Example 1 and varying a fixing temperature, and the fixing property at image formation (lowest fixing temperature, hot offset occurring temperature), the image density uniformity (fixing temperature 180° C.), the glossiness of an image (fixing temperature 180° C.) and the blocking property of an image (fixing temperature 160° C.) are assessed. The details of various methods of assessing the fixing property and the image, and the assessment criteria will be described later.

The image forming method is an image forming method comprising at least a step of forming an electrostatic latent image on an electrostatic image carrier, a step of developing the electrostatic latent image using a developer to form a toner image, a step of transferring the toner image on a transfer body, and a step of thermally fixing the toner image, in which oil-less fixation is performed using a fixing roll having the surface covered with a PFA tube, and a process speed is set at 180 mm/sec. In addition, as a transfer paper, J coated paper manufactured by Fuji Xerox Co., Ltd. is used.

As a result, it is confirmed that the lowest fixing temperature is 140° C. and, at a temperature not lower than this temperature, an image exhibited the sufficient fixing property, and a transfer paper is peeled without any resistance. In addition, the surface glossiness of an image at a fixing temperature of 180° C. is so better as 50%, the developability and the transferability are both better, the uniformity of the image density is high, and a high chroma is exhibited. Further occurrence of hot offset is not observed even at a fixing temperature of 220° C. In addition, the blocking property of an image is not problematic at all, and adhesion between images, the image defects and change of the glossiness with time are not observed at all.

In addition to the above various assessments, in order to assess the preservability of a toner (toner caking property), 20 g of a toner before external addition of hydrophobic silica, contained in an aluminium cup is stored in a constant temperature bath retained at 50° C. for 24 hours, and taken out therefrom, and an extent of occurrence of caking is assessed. As a result, although slight reduction of the flowability is observed in the toner after storage as compared with before storage, this is a caking level having no practical problem.

Example 2

(Preparation of Toner Particle and Developer)

A toner particle is obtained according to the same manner as that of Example 1 except that the binder resin fine particle dispersion (2) is used in place of the binder resin fine particle dispersion (1), the colorant particle dispersion (2) is used in place of the colorant particle dispersion (1), and a pH is maintained at 4.5 when a temperature of solution in the flask is retained at 95° C. in a coalescing step, in Example 1.

In this toner particle, an accumulated volume average particle diameter $D_{50}$ is 5.55 μm, a volume average particle size distribution index GSDv is 1.19, and a surface index is 1.32. A shape factor SF1 is 120 (spherical).

Then, a developer is prepared after an external additive is added to the surface of this toner particle as in Example 1, to obtain a developer of Example 2.

(Assessment)

Assessment is performed using the developer of Example 2 as in Example 1. As a result, it is confirmed that the lowest fixing temperature is 125° C. and, at a temperature not lower than this temperature, an image exhibited the sufficient fixing property, and a transfer paper is peeled without any resistance. In addition, the surface glossiness of an image at a fixing temperature of 180° C. is so better as 66%, the developability and the transferability are both better, the uniformity of image density is high, and a high chroma is exhibited. Further, although slight occurrence of hot offset is observed at a fixing temperature of 200° C., it is a level having no practical problem. In addition, the blocking property of an image is not problematic at all, and adhesion between images, the image defects and change of the glossiness with time are not observed at all.

In addition to the above various assessments, in order to assess the preservability of a toner (toner caking property), 20 g of a toner before external addition of hydrophobic silica, contained in an aluminium cup is stored in a constant temperature bath retained at 50° C. for 24 hours, and taken out therefrom, and an extent of occurrence of caking is assessed. As a result, although reduction of the flowability is observed in the toner after storage as compared with before storage, this is a caking level having little practical problem.

These results are shown in Table 1 together with various conditions at the preparation of toner particle and results of various assessments of shapes of the toner.

Example 3

(Preparation of Toner and Developer)

A toner particle is obtained according to the same manner as that of Example 1 except that the binder resin fine particle dispersion (3) is used in place of the binder resin fine particle dispersion (1), the colorant particle dispersion (3) is used in place of the colorant particle dispersion (1), and a pH is maintained at 6.5 when a temperature of solution in the flask is retained at 95° C. in a coalescing step, in Example 1.

In this toner particle, an accumulated volume average particle diameter $D_{50}$ is 5.75 μm, a volume average particle size distribution index GSDv is 1.22, and a surface index is 1.90. A shape factor SF1 is 138 (potato shape).

Then, a developer is prepared after an external additive is added to the surface of this toner particle, as in Example 1, to obtain a developer of Example 3.

(Assessment)

Assessment is performed using the developer of Example 3 as in Example 1. As a result, it is confirmed that the lowest fixing temperature is 135° C. and, at a temperature not lower than this temperature, an image exhibited the sufficient fixing property, and a transfer paper is peeled without any resistance. In addition, the surface glossiness of an image at a fixing temperature of 180° C. is so better as 47%, the developability and the transferability are both better, the uniformity of image density is high, and a high chroma is exhibited. Further, occurrence of hot offset is not observed even at a fixing temperature of 220° C. In addition, the blocking property of an image is not problematic at all, and adhesion between images, the image defects and change of the glossiness with time are not observed at all.

In addition to the above various assessments, in order to assess the preservability of a toner (toner caking property), 20 g of a toner before external addition of hydrophobic silica, contained in an aluminium cup is stored in a constant temperature bath retained at 50° C. for 24 hours, and taken out therefrom, and an extent of occurrence of caking is assessed. As a result, although slight reduction of the flowability is observed in the toner after storage as compared with before storage, this is a caking level having no practical problem.

These results are shown in Table 1 together with various conditions at the preparation of toner particle and results of various assessments of shapes of the toner.

Example 4

(Preparation of Toner and Developer)

A toner particle is obtained according to the same manner as that of Example 1 except that the binder resin fine particle dispersion (4) is used in place of the binder resin fine particle dispersion (1), the colorant particle dispersion (4) is used in place of the colorant particle dispersion (1), and a pH is maintained at 4.0 when a temperature of solution in the flask is retained at 95° C. in a coalescing step, in Example 1.

In this toner particle, an accumulated volume average particle diameter $D_{50}$ is 6.50 μm, a volume average particle size distribution index GSDv is 1.22, and a surface index is 1.18. A shape factor SF1 is 115 (spherical).

Then, a developer is prepared after an external additive is added to the surface of this toner particle, as in Example 1, to obtain a developer of Example 4.

(Assessment)

Assessment is performed using the developer of Example 4 as in Example 1. As a result, it is confirmed that the lowest fixing temperature is 135° C. and, at a temperature not lower than this temperature, an image exhibited the sufficient fixing property, and a transfer paper is peeled without any resistance. In addition, the surface glossiness of an image at a fixing temperature of 180° C. is so better as 55%, the developability and the transferability are both better, the uniformity of image density is high, and a high chroma is exhibited. Further, occurrence of hot offset is not observed even at a fixing temperature of 220° C. In addition, the blocking property of an image is not problematic at all, and adhesion between images, the image defects and change of the glossiness with time are not observed at all.

In addition to the above various assessments, in order to assess the preservability of a toner (toner caking property), 20 g of a toner before external addition of hydrophobic silica, contained in an aluminium cup is stored in a constant temperature bath retained at 50° C. for 24 hours, and taken out therefrom, and an extent of occurrence of caking is assessed. As a result, although slight reduction of the flowability is observed in the toner after storage as compared with before storage, this is a caking level having no practical problem.

These results are shown in Table 1 together with various conditions at the preparation of toner particle and results of various assessments of shapes of the toner.

Example 5

(Preparation of Toner Particle and Developer)

-Aggregating Step-

Binder resin fine particle dispersion (8): 200 parts by weight (resin 84 parts by weight)

Colorant particle dispersion (1): 40 parts by weight (pigment 8.6 parts by weight)

Dicarboxylic acid compound particle dispersion (1): 10 parts by weight (dicarboxylic acid compound 2.15 parts by weight)

Releasing agent particle dispersion: 30 parts by weight (releasing agent; 6.45 parts by weight)

Polyaluminium chloride: 0.15 part by weight

The above components are well mixed and dispersed with a homogenizer (Ultratarax TSO manufactured by IKA) in a round-type stainless flask, the dispersion in the flask is heated to 48° C. in a heating oil bath while stirred, and retained at 48° C. for 60 minutes, and 68 parts by weight (resin; 28.56 parts by weight) of the binder resin fine particle dispersion (6) is added and they are stirred slowly.

-Coalescing Step-

Thereafter, a pH of the dispersion in the flask is adjusted to 6.5 with a 0.5 mol/liter aqueous sodium hydroxide solution, and the dispersion in the flask is heated to 95° C. while continuing to be stirred. During elevation of a temperature to 95° C., in the usual case, the pH of the dispersion in the flask is lowered to around 5.0, but the state is retained as it is.

-Filtering, Washing and Drying Steps-

After completion of the reaction, the solution in the flask is cooled and filtered to obtain solid matters. Then, the solid matters are washed well with ion-exchanged water, followed by solid-liquid separation by Nuche suction filtration to obtain again solid matters.

Then, the solid matters are dispersed again in 3 liter of ion-exchanged water at 40° C., followed by stirring and washing of the dispersion at 300 rpm for 15 minutes. This washing procedure is repeated 5 times, and subjected to solid-liquid separation by Nuche suction filtration and, then, vacuum drying is performed for 12 hours to obtain a toner particle having a capsule structure composed of a core layer and a shell layer.

A particle diameter of this toner particle is measured with a coulter counter, and an accumulated volume average particle diameter $D_{50}$ is 5.6 μm, a volume average particle size distribution index GSDv is 1.21, and a surface index is 1.45. In addition, a shape factor SF1 of the toner particle obtained by shape observation with a Ruzex image analyzing apparatus is 128 (potato shape).

-Addition of External Additive and Preparation of Developer-

Then, 1.2 parts by weight of hydrophobic silica (TS720 manufactured by Cabot Corporation) is added to 50 parts by weight of the above toner particle, and the materials are mixed with a sample mill to obtain a toner particle (toner of Example 5), with hydrophobic silica externally added to the surface of the toner particle.

Thereafter, a ferrite carrier having an average particle diameter of 50 μm in which the surface of the ferrite particle is covered with polymethyl methacrylate (manufactured by Soken Chemical & Engineering Co., Ltd.) (a blending ratio of polymethyl methacryalte relative to ferrite particle; 1% by weight) is mixed therein so that the concentration of the toner particle with hydrophobic silica externally added thereto becomes 5% by weight, and materials are stirred and mixed with a ball mill for 5 minutes to obtain a developer of Example 5.

(Assessment)

Assessment is performed using the developer of Example 5 as in Example 1. As a result, it is confirmed that the lowest fixing temperature is 125° C. and, at a temperature not lower than this temperature, an image exhibited the sufficient fixing property, and a transfer paper is peeled without any resistance. In addition, the surface glossiness of an image at a fixing temperature of 180° C. is so better as 48%, the developability and the transferability are both better, the uniformity of image density is high, and a high chroma is exhibited. Further, hot offset did not occur even at a fixing temperature of 220° C. In addition, the blocking property of an image is not problematic at all, and adhesion between images, the image defects and change of the glossiness with time are not observed at all.

In addition to the above various assessments, in order to assess the preservability of a toner (toner caking property), 20 g of a toner before external addition of hydrophobic silica, contained in an aluminium cup is stored in a constant temperature bath retained at 50° C. for 24 hours, and taken out therefrom, and an extent of occurrence of caking is assessed. As a result, no change is observed in the toner after storage as compared with before storage, and no caking occurred.

These results are shown in Table 1 together with various conditions at the preparation of toner particle and results of various assessments of shapes of the toner.

Example 6

(Preparation of Toner and Developer)

A toner particle having a capsule structure composed of a core layer and a shell layer is obtained according to the same manner as that of Example 5 except that the binder resin fine particle dispersion (9) is used in place of the binder resin fine particle dispersion (8), the colorant particle dispersion (2) is used in place of the colorant particle dispersion (1), and a pH is maintained at 4.5 when a temperature of solution in the flask is retained at 95° C. in a coalescing step, in Example 5.

In this toner particle, an accumulated volume average particle diameter $D_{50}$ is 5.45 μm, a volume average particle size distribution index GSDv is 1.19, and a surface index is 1.15. A shape factor SF1 is 118 (spherical).

Then, a developer is prepared after an external additive is added to the surface of this toner particle, as in Example 5, to obtain a developer of Example 6.

(Assessment)

Assessment is performed using the developer of Example 6 as in Example 1. As a result, it is confirmed that the lowest fixing temperature is 115° C. and, at a temperature not lower than this temperature, an image exhibited the sufficient fixing property, and a transfer paper is peeled without any resistance. In addition, the surface glossiness of an image at a fixing temperature of 180° C. is so better as 68%, the developability and the transferability are both better, the uniformity of image density is high, and a high chroma is exhibited. Further, although slight occurrence of hot offset is observed at a fixing temperature of 200° C., this is a level having no practical problem. In addition, the blocking property of an image is not problematic at all, and adhesion between images, the image defects and change of the glossiness with time are not observed at all.

In addition to the above various assessments, in order to assess the preservability of a toner (toner caking property), 20 g of a toner before external addition of hydrophobic silica, contained in an aluminium cup is stored in a constant temperature bath retained at 50° C. for 24 hours, and taken out therefrom, and an extent of occurrence of caking is assessed. As a result, no change is observed in the toner after storage as compared with before storage, and no caking occurred.

These results are shown in Table 1 together with various conditions at the preparation of toner particle and results of various assessments of shapes of the toner.

Example 7

(Preparation of Toner and Developer)

A toner particle having a capsule structure composed of a core layer and a shell layer is obtained according to the same manner as that of Example 6 except that the binder resin fine particle dispersion (10) is used in place of the binder resin fine particle dispersion (9) upon formation of a core layer, and the colorant particle dispersion (3) is used in place of the colorant particle dispersion (2), the binder resin fine particle dispersion (7) is used in place of the binder resin fine particle dispersion (6) upon formation of a shell layer, and a pH is maintained at 6.5 when a temperature of the solution in the flask in a coalescing step is retained at 95° C., in Example 6.

In this toner particle, an accumulated volume average particle diameter $D_{50}$ is 6.00 μm, a volume average particle size distribution index GSDv is 1.21, and a surface index is 1.95. A shape factor SF1 is 139 (potato shape).

Then, a developer is prepared after an external additive is added to the surface of this toner particle, as in Example 5, to obtain a developer of Example 7.

(Assessment)

Assessment is performed using the developer of Example 7 as in Example 1. As a result, it is confirmed that the lowest fixing temperature is 130° C. and, at a temperature not lower than this temperature, an image exhibited the sufficient fixing property, and a transfer paper is peeled without any resistance. In addition, the surface glossiness of an image at a fixing temperature of 180° C. is so better as 50%, the developability and the transferability are both better, the uniformity of image density is high, and a high chroma is exhibited. Further, no occurrence of hot offset is observed even at a fixing temperature of 220° C. In addition, the blocking property of an image is not problematic at all, and adhesion between images, the image defects and change of the glossiness with time are not observed at all.

In addition to the above various assessments, in order to assess the preservability of a toner (toner caking property), 20 g of a toner before external addition of hydrophobic silica, contained in an aluminium cup is stored in a constant temperature bath retained at 50° C. for 24 hours, and taken out therefrom, and an extent of occurrence of caking is assessed. As a result, no change is observed in the toner after storage as compared with before storage, and no caking occurred.

These results are shown in Table 1 together with various conditions at the preparation of toner particle and results of various assessments of shapes of the toner.

Example 8

A toner particle having a capsule structure composed of core layer and a shell layer is obtained according to the same manner as that of Example 7 except that the binder resin fine particle dispersion (11) is used in place of the binder resin fine particle dispersion (10), the colorant particle dispersion (4) is used in place of the colorant particle dispersion (3), and a pH is maintained at 4.0 when a temperature of the solution in the flask is retained at 95° C. in a coalescing step, in Example 7.

In this toner particle, an accumulated volume average particle diameter $D_{50}$ is 6.80 μm, a volume average particle size distribution index GSDv is 1.22, and a surface index is 1.10. A shape factor SF1 is 116 (spherical).

Then, a developer is prepared after an external additive is added to the surface of this toner particle, as in Example 5, to obtain a developer of Example 8.

(Assessment)

Assessment is performed using the developer of Example 8 as in Example 1. As a result, it is confirmed that the lowest fixing temperature is 110° C. and, at a temperature not lower than this temperature, an image exhibited the sufficient fixing property, and a transfer paper is peeled without any resistance. In addition, the surface glossiness of an image at a fixing temperature of 180° C. is so better as 60%, the developability and the transferability are both better, the uniformity of image density is high, and a high chroma is exhibited. Further, although slight occurrence of hot offset is observed at a fixing temperature of 200° C., this is a level having no practical problem. In addition, the blocking property of an image is not problematic at all, and adhesion between images, the image defects and change of the glossiness with time are not observed at all.

In addition to the above various assessments, in order to assess the preservability of a toner (toner caking property), 20 g of a toner before external addition of hydrophobic silica, contained in an aluminium cup is stored in a constant temperature bath retained at 50° C. for 24 hours, and taken out therefrom, and an extent of occurrence of caking is assessed. As a result, no change is observed in the toner after storage as compared with before storage, and no caking occurred.

These results are shown in Table 1 together with various conditions at the preparation of toner particle and results of various assessments of shapes of the toner.

Comparative Example 1

(Preparation of Toner and Developer)

A toner particle is obtained according to the same manner as that of Example 2 except that the binder resin fine particle dispersion (5) is used in place of the binder resin fine particle dispersion (2), and a pH is maintained at 7.0 when a temperature of the solution in the flask is retained at 95° C. in a coalescing step, in Example 2.

In this toner particle, an accumulated volume average particle diameter $D_{50}$ is 5.45 μm, a volume average particle size distribution index GSDv is 1.25, and a surface index is 2.10. A shape factor SF1 is 143 (amorphous shape).

Then, a developer is prepared after an external additive is added to the surface of this toner particle, as in Example 1, to obtain a developer of Comparative Example 1.

(Assessment)

Assessment is performed using the developer of Comparative Example 1 as in Example 1. As a result, it is confirmed that a lowest fixing temperature is 130° C. and, at a temperature not lower than this temperature, the image exhibited the sufficient fixing property, and a transfer paper is peeled without any resistance. In addition, although the surface glossiness of the image at a fixing temperature of 180° C. is so better as 60%, both the developability and the transferability are inferior, and the uniformity of the image density is not obtained sufficiently. In addition, slight occurrence of hot offset is observed at a fixing temperature of 200° C.

In addition, regarding the blocking property of the image, two images are completely adhered and, when they are forced to be peeled, the papers brake. These results are shown in Table 1 together with various conditions at the preparation of a toner particle, and the results of various assessments of shapes of the toner.

Comparative Example 2

(Preparation of Toner and Developer)

A toner particle is obtained according to the same manner as that of Example 2 except that the binder resin fine particle dispersion (5) is used in place of the binder resin fine particle dispersion (2), and a pH is maintained at 4.5 when a temperature of the solution in the flask is retained at 95° C. in a coalescing step, in Example 2.

In this toner particle, an accumulated volume average particle diameter $D_{50}$ is 6.30 μm, a volume average particle size distribution index GSDv is 1.25, and a surface index is 1.35. A shape factor SF1 is 121 (spherical).

Then, a developer is prepared after an external additive is added to the surface of this toner particle, as in Example 1, to obtain a developer of Comparative Example 2.

(Assessment)

Assessment is performed using the developer of Comparative Example 1 as in Example 1. As a result, it is confirmed that the lowest fixing temperature is 130° C. and, at a temperature not lower than this temperature, the image exhibited the sufficient fixing property, and a transfer paper is peeled without any resistance. In addition, the surface glossiness of the image at a fixing temperature of 180° C. is so better as 62%, both the developability and the transferability are better, and the uniformity of the image density is a level having no problem. In addition, slight occurrence of hot offset is observed at a fixing temperature of 180° C.

In addition, regarding the blocking property of the image, two images are completely adhered and, when they are forced to be peeled, the papers brake, and the blocking property is remarkably deteriorated. These results are shown in Table 1 together with various conditions at the preparation of a toner particle, and the results of various assessments of shapes of the toner.

TABLE 1

| | Example | | | | | | | | Comparative Example | |
|---|---|---|---|---|---|---|---|---|---|---|
| | 1 | 2 | 3 | 4 | 5 | 6 | 7 | 8 | 1 | 2 |
| Shell layer | | | | | | | | | | |
| Binder resin Particle dispersion | (1) | (2) | (3) | (4) | (6) | (6) | (7) | (7) | (5) | (5) |
| Part by weight | 68 | 68 | 68 | 68 | 68 | 68 | 68 | 68 | 68 | 68 |
| Cyclic reactive group | Epoxy group | Epoxy group | Aziridinyl group | Oxazoline group | — | — | — | — | None | None |
| Monomer containing polar group | Acrylic acid | Acrylic acid | Methacrylic acid | Carboxyethyl acrylate | — | — | — | — | Acrylic acid | Acrylic acid |
| Glass transition temperature (° C.) of binder resin | 51.5 | 45.5 | 58.8 | 55.5 | 60.5 | 60.5 | 61.5 | 61.5 | 46.5 | 46.5 |
| Core layer | | | | | | | | | | |
| Binder resin Particle dispersion | (1) | (2) | (3) | (4) | (8) | (9) | (10) | (11) | (5) | (5) |
| Part by weight | 200 | 200 | 200 | 200 | 200 | 200 | 200 | 200 | 200 | 200 |
| Cyclic reactive group | Epoxy group | Epoxy group | Aziridinyl group | Oxazoline group | Epoxy group | Epoxy group | Aziridinyl group | Oxazoline group | None | None |
| Monomer containing polar group | Acrylic acid | Acrylic acid | Methacrylic acid | Carboxyethyl acrylate | Acrylic acid | Acrylic acid | Methacrylic acid | Carboxyethyl acrylate | Acrylic acid | Acrylic acid |
| Glass transition temperature (° C.) of binder resin | 51.5 | 45.5 | 58.8 | 55.5 | 48.5 | 45 | 53.8 | 45.5 | 46.5 | 46.5 |
| Dicarboxylic acid compound dispersion | — | — | — | — | (1) | (1) | (1) | (2) | — | — |
| Dicarboxylic acid species | — | — | — | — | Dodecaned i-acid | Dodecaned i-acid | Dodecaned i-acid | Sebacic acid | — | — |
| Part by weight | — | — | — | — | 10 | 10 | 10 | 10 | — | — |
| Colorant dispersion | (1) | (2) | (3) | (3) | (1) | (2) | (3) | (3) | (2) | (2) |
| Part by weight | 40 | 40 | 40 | 40 | 40 | 40 | 40 | 40 | 40 | 40 |
| Releasing agent dispersion | (1) | (1) | (1) | (1) | (1) | (1) | (1) | (1) | (1) | (1) |
| Part by weight | 40 | 40 | 40 | 40 | 30 | 30 | 30 | 30 | 40 | 40 |
| Toner | | | | | | | | | | |
| Accumulated volume average particle diameter | 5.90 | 5.55 | 5.75 | 6.50 | 5.6 | 5.45 | 6 | 6.8 | 5.45 | 6.30 |

TABLE 1-continued

| | Example | | | | | | | | Comparative Example | |
|---|---|---|---|---|---|---|---|---|---|---|
| | 1 | 2 | 3 | 4 | 5 | 6 | 7 | 8 | 1 | 2 |
| (μm) | | | | | | | | | | |
| Shape factor SF1 | 126 | 120 | 138 | 115 | 128 | 118 | 139 | 116 | 143 | 121 |
| Surface index | 1.55 | 1.32 | 1.90 | 1.18 | 1.45 | 1.15 | 1.95 | 1.10 | 2.1 | 1.35 |
| Assessment | | | | | | | | | | |
| Lowest fixing temperature (° C.) | 140 | 125 | 135 | 135 | 125 | 115 | 130 | 110 | 130 | 130 |
| Hot offset temperature (° C.) | >220 | 200 | >220 | >220 | >220 | 200 | >220 | 200 | 200 | 180 |
| Uniformity of image density | ○ | ○ | ○ | ○ | ○ | ○ | ○ | ○ | X | ○ |
| Glossiness (%) of image | 50 | 66 | 47 | 55 | 48 | 63 | 50 | 60 | 60 | 62 |
| Blocking property of image | ○ | ○ | ○ | ○ | ○ | ○ | ○ | ○ | X | X |
| Toner caking property | ○- | Δ | ○- | ○- | ○ | ○ | ○ | ○ | — | — |

(Various Methods of Assessing Fixing Property and Image, and Assessment Criteria)

-Lowest Fixing Temperature-

In assessment of a lowest fixing temperature, a highest fixing temperature at which contamination of an image occurs when an image is rubbed with a cloth, is regarded as a lowest fixing temperature.

-Hot Offset Occurring Temperature-

A hot offset occurring temperature is obtained by confirming a lowest fixing temperature at which a toner adheres to a fixing roll.

-Uniformity of Image Density-

Uniformity of the image density is evaluated by placing a 5 cm square plane image on a central part and four corners in a manuscript image, confirming the equivalence of the image density at five points with naked eyes, and determining them by ○ and X.

"○" in Table 1 means that the image density is uniform at a level having no practical problem, and "X" means that the image density is uneven at a level causing practical problem.

-Glossiness of Image-

The glossiness is assessed by measuring the 75 degrees glossiness of an image formed on a J coated paper manufactured by Fuji Xerox Co., Ltd., with a glossmeter GMD manufactured by Murakami Color Research Laboratory.

-Blocking Property of Image-

The blocking property of an image is assessed as follows: First, two plain images fixed at 160° C. is cut into two 5 cm square, image surfaces of this plain images are overlaid face to face, and a weight is placed thereon applying a load of 80 g/cm$^2$ on the image surface. In this state, two plain images with image surfaces overlaid are allowed to stand in a constant temperature bath at 60° C. for 48 hours, and taken out, followed by cooling. Then, two plain images with image surfaces overlaid are peeled and, thereupon, whether the image defect occurs or not is confirmed by observation with naked eyes, whereby, the blocking property of the image is assessed.

"○" in Table 1 means the state where no adhesion is observed when two images are peeled, and the image defect or change of the glossiness of the time is not observed, and a "X" means the state where adhesion is observed when two images are peeled, and break of a paper or the image defect occurs when peeled.

-Assessment of Toner Caking Property-

The toner caking property is assessed by taking out 20 g of a toner before external addition of hydrophobic silica placed in an aluminium cup is stored in a constant temperature bath retained at 50° C. for 24 hours, and assessing the presence or the absence of occurrence of caking.

"○" in Table 1 means the state where no caking of a toner occurs after storage, and no change in a toner is observed before and after storage, "X" means the state where a toner is completely solidified arising a practical problem, and "Δ" means the state where slight caking is observed, but a toner can be utilized practically. Addition of a symbol of minus (−) to a symbol "○" means slightly inferior.

As explained above, the invention can provide a toner for developing electrostatic images which can form an image having the excellent thermal durability and mechanical property, a process for preparing the toner for developing electrostatic images, a developer for developing electrostatic images and an image forming method.

What is claimed is:

1. A toner for developing electrostatic images, comprising a colorant and a binder resin, said toner containing a reactive polymer which cross-links when heated to a temperature that is higher than 100° C., and having a shape factor SF1 of 110 to 140 represented by:

$$SF1 = ML^2/(4A/\pi \times 100)$$

wherein, ML represents a maximum length (μm) of the toner, and A represents a projected area (μm$^2$) of the toner;

wherein the toner has a layered-structure containing at least a shell layer provided so as to cover the surface thereof, and a core layer provided on an inner side of the shell layer; and the binder resin is contained in the core layer and the shell layer, and a glass transition temperature of a binder resin contained in the core layer is lower than a glass transition temperature of a binder resin contained in the shell layer.

2. A toner for developing electrostatic images according to claim 1, wherein the toner is prepared at least via an aggregating step of aggregating particles containing at least particles of the binder resin in a dispersion with the particles dispersed therein, to obtain an aggregation of the particles, and a coalescing step of coalescing the aggregation of the particles by heating.

3. A toner for developing electrostatic images according to claim 1, wherein the reactive polymer contains one or more kinds of cyclic reactive groups which cross-link at a temperature that is higher than 100° C.

4. A toner for developing electrostatic images according to claim 3, wherein the cyclic reactive group is any one of an epoxy group, an aziridinyl group and an oxazoline group.

5. A toner for developing electrostatic images according to claim 3, wherein the reactive polymer is a vinyl type resin containing one or more kinds of cyclic reactive groups.

6. A toner for developing electrostatic images according to claim 3, the toner containing a compound having a carboxyl group.

7. A toner for developing electrostatic images according to claim 6, wherein the carboxyl group is a dicarboxylic acid.

8. A toner for developing electrostatic images according to claim 1, wherein the binder resin is the reactive polymer.

9. A toner for developing electrostatic images according to claim 1, having a surface index value represented by the following formula (2) of 2.0 or less:

(Surface index value)=(measured specific surface area value)/(calculated specific surface area value) Formula (2)

wherein, in the formula (2), the calculated specific surface area value is represented by $6\Sigma(n\times R^2)/\{\rho\times\Sigma(n\times R^3)\}$; and, in the above formula representing the specific surface area, n represents a number of particles in a channel (number/1 channel) in the coulter counter, R represents a channel particle diameter (μm) in a coulter counter, Σ represents a toner density (g/μm3), a dividing number of the number of channels is 16, and a size of division is an interval of 0.1 at a log scale.

10. A toner for developing electrostatic images according to claim 1, wherein a glass transition temperature of the binder resin is in a range of 45° C. to 75° C.

11. A toner for developing electrostatic images according to claim 1, wherein the reactive polymer is contained at least in the core layer.

12. A toner for developing electrostatic images according to claim 1, wherein a glass transition temperature of a binder resin contained in the core layer is in a range of 50° C. to 75° C.

13. A developer for developing electrostatic images, comprising a carrier and a toner for developing electrostatic images, said toner comprising a colorant, a binder resin, and a reactive polymer which cross-links when heated to a temperature that is higher than 100° C., and the toner having a shape factor SF1 of 110 to 140 represented by:

$$SF1 = ML^2/(4A/\Sigma\times 100)$$

wherein, ML represents a maximum length (μm) of the toner, and A represents a projected area ($\mu m^2$) of the toner;

wherein the toner has a layered-structure containing at least a shell layer provided so as to cover the surface thereof, and a core layer provided on an inner side of the shell layer; and the binder resin is contained in the core layer and the shell layer, and a glass transition temperature of a binder resin contained in the core layer is lower than a glass transition temperature of a binder resin contained in the shell layer.

* * * * *